US009616352B2

(12) United States Patent
Lau

(10) Patent No.: US 9,616,352 B2
(45) Date of Patent: Apr. 11, 2017

(54) INTERACTIVE TALKING TOY

(71) Applicant: Giggles International Limited, Hong Kong (HK)

(72) Inventor: Chun Yuen Lau, Hong Kong (HK)

(73) Assignee: GIGGLES INTERNATIONAL LIMITED, Hong Kong (HK)

( * ) Notice: Subject to any disclaimer, the term of this patent is extended or adjusted under 35 U.S.C. 154(b) by 811 days.

(21) Appl. No.: 14/086,999

(22) Filed: Nov. 22, 2013

(65) Prior Publication Data

US 2014/0148078 A1 May 29, 2014

Related U.S. Application Data

(60) Provisional application No. 61/730,067, filed on Nov. 27, 2012.

(51) Int. Cl.
*A63H 3/28* (2006.01)

(52) U.S. Cl.
CPC ..... *A63H 3/28* (2013.01); *A63H 2200/00* (2013.01)

(58) Field of Classification Search
CPC ..... A63H 3/28; A63H 2200/00
See application file for complete search history.

(56) References Cited

U.S. PATENT DOCUMENTS

2001/0034180 A1* 10/2001 Fong ..... A63H 3/28 446/175
2002/0000062 A1* 1/2002 Smirnov ..... A63H 3/28 44/397
2004/0038620 A1* 2/2004 Small ..... A63H 30/04 446/491
2009/0117819 A1* 5/2009 Nakamura ..... A63H 3/28 446/297
2009/0264205 A1* 10/2009 Atsmon ..... A63H 3/28 463/42

* cited by examiner

*Primary Examiner* — Jasson Yoo

(57) ABSTRACT

A method and system for wireless communication are disclosed. The method comprises: the master device generates a sequence code through a specific encoder and transmits the sequence code to each slave device continuously within a preset period according to the communication demand, wherein the specific encoder is a feedback shift register constructed by a specific polynomial, of which the coefficients and the order are in correlation with the communication demand while all of the coefficients and initial values are not equal to 0 at the same time; the preset period is greater than or equal to the sum of a sleeping period and a detecting period of the slave device, which constitutes a sleeping-and-waking cycle; the slave device receives a continuous section of the sequence code in the detecting period, decodes the sequence code through a decoder corresponding to the encoder, and performs corresponding operation according to the decoding result.

20 Claims, 14 Drawing Sheets

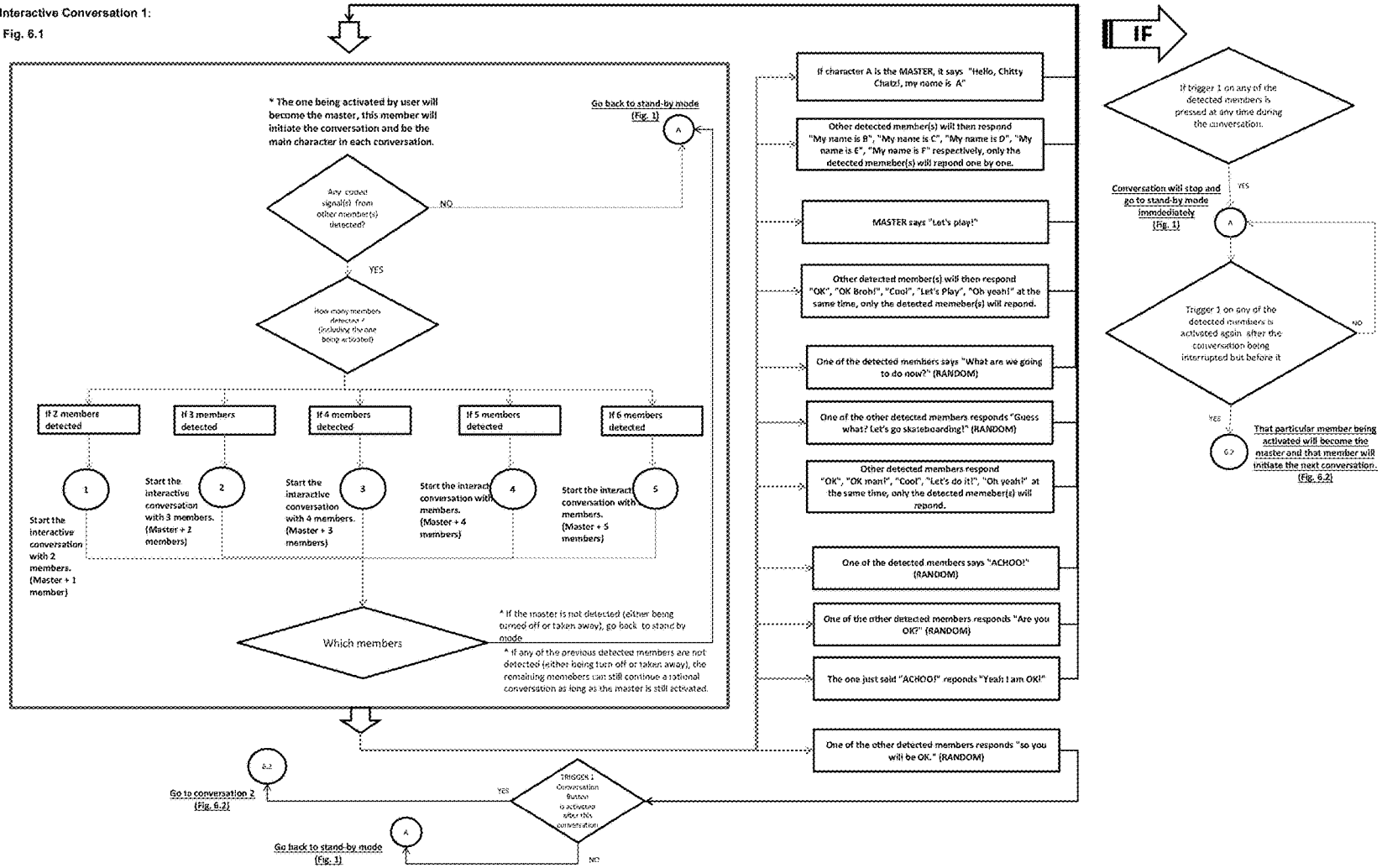
Interactive Conversation 1:
Fig. 6.1

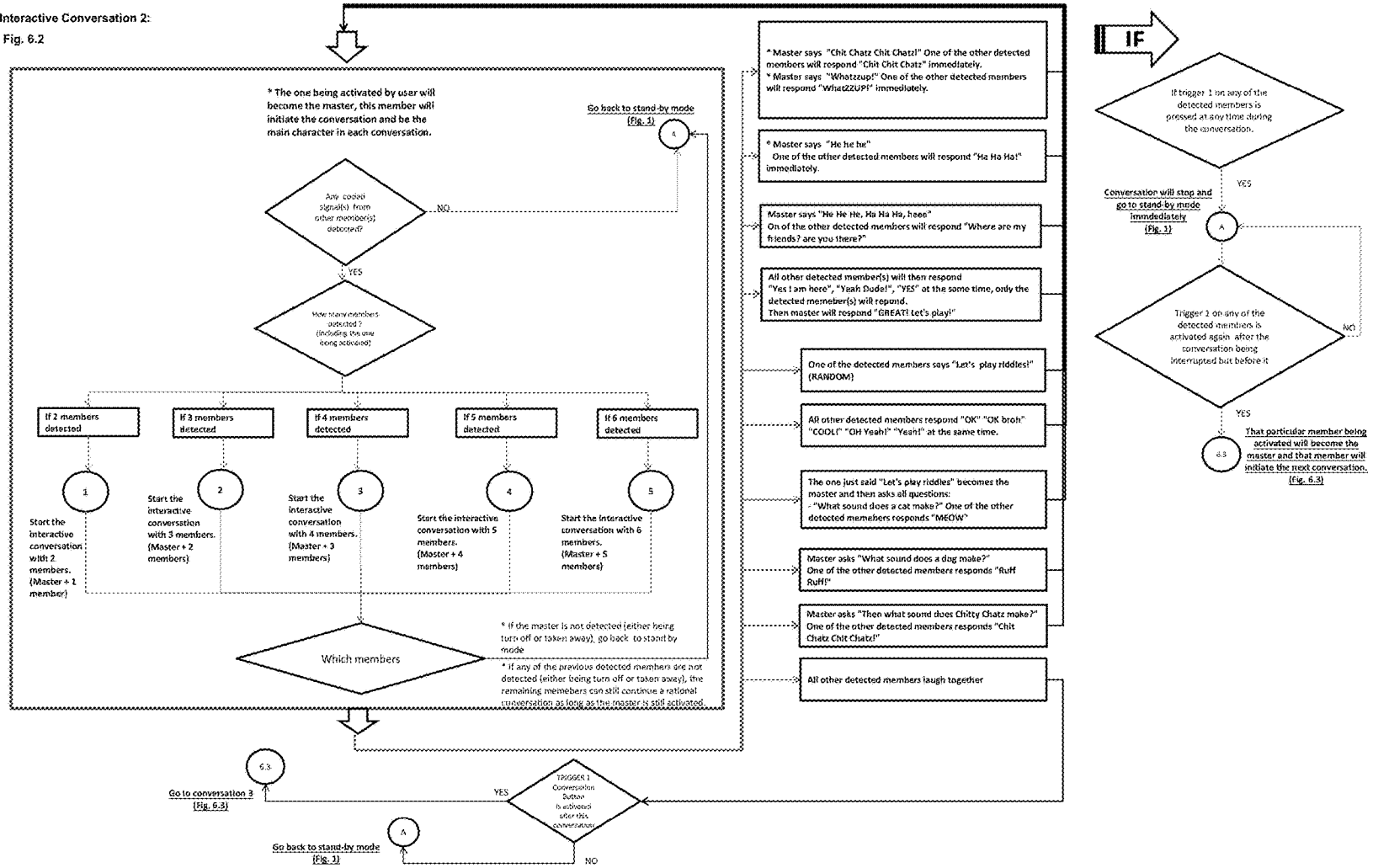
Interactive Conversation 2:
Fig. 6.2

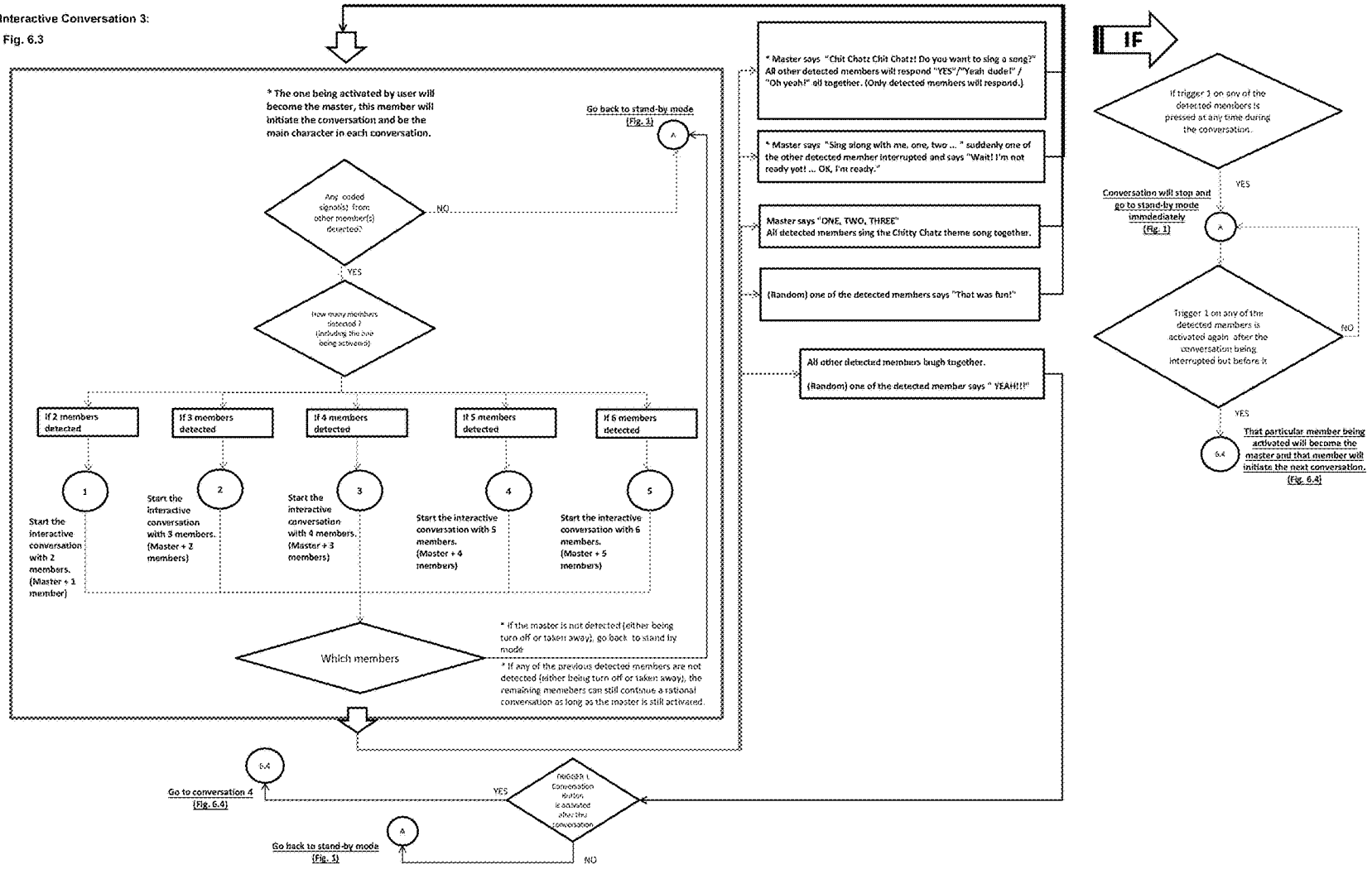
IF
If trigger 1 on any of the detected members is pressed at any time during the conversation.
YES
Conversation will stop and go to stand-by mode immediately (Fig. 1)
A
Trigger 1 on any of the detected members is activated again after the conversation being interrupted but before it
NO
YES
That particular member being activated will become the master and that member will initiate the next conversation. (Fig. 6.4)
6.4
* Master says "Chit Chatz Chit Chatz! Do you want to sing a song?" All other detected members will respond "YES" /"Yeah dude!" / "Oh yeah!" all together. (Only detected members will respond.)
* Master says "Sing along with me, one, two ... " suddenly one of the other detected member interrupted and says "Wait! I'm not ready yet ... OK, I'm ready."
Master says "ONE, TWO, THREE" All detected members sing the Chitty Chatz theme song together.
(Random) one of the detected members says "That was fun!"
All other detected members laugh together. (Random) one of the detected member says " YEAH!!!"
Interactive Conversation 3:
Fig. 6.3
* The one being activated by user will become the master, this member will initiate the conversation and be the main character in each conversation.
Go back to stand-by mode (Fig. 1)
A
Any coded signal(s) from other member(s) detected?
NO
YES
How many members detected ? (including the one being activated)
If 2 members detected
If 3 members detected
If 4 members detected
If 5 members detected
If 6 members detected
1
2
3
4
5
Start the interactive conversation with 2 members. (Master + 1 member)
Start the interactive conversation with 3 members. (Master + 2 members)
Start the interactive conversation with 4 members. (Master + 3 members)
Start the interactive conversation with 5 members. (Master + 4 members)
Start the interactive conversation with 6 members. (Master + 5 members)
Which members
* If the master is not detected (either being turn off or taken away), go back to stand by mode
* If any of the previous detected members are not detected (either being turn off or taken away), the remaining memebers can still continue a rational conversation as long as the master is still activated.
Master's Conversation button is activated while the conversation
YES
NO
6.4
Go to conversation 4 (Fig. 6.4)
A
Go back to stand-by mode (Fig. 1)

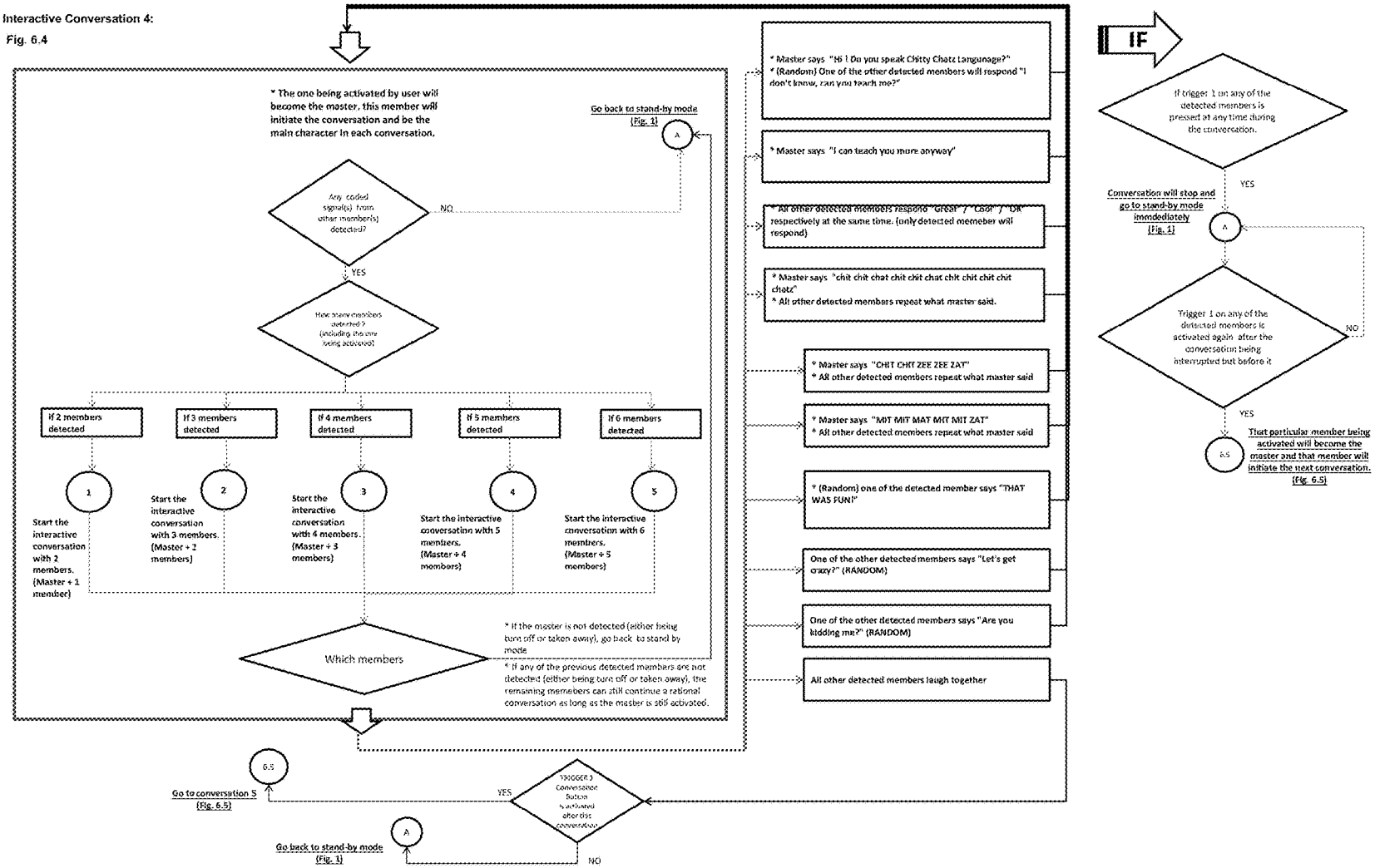
Interactive Conversation 4:
Fig. 6.4

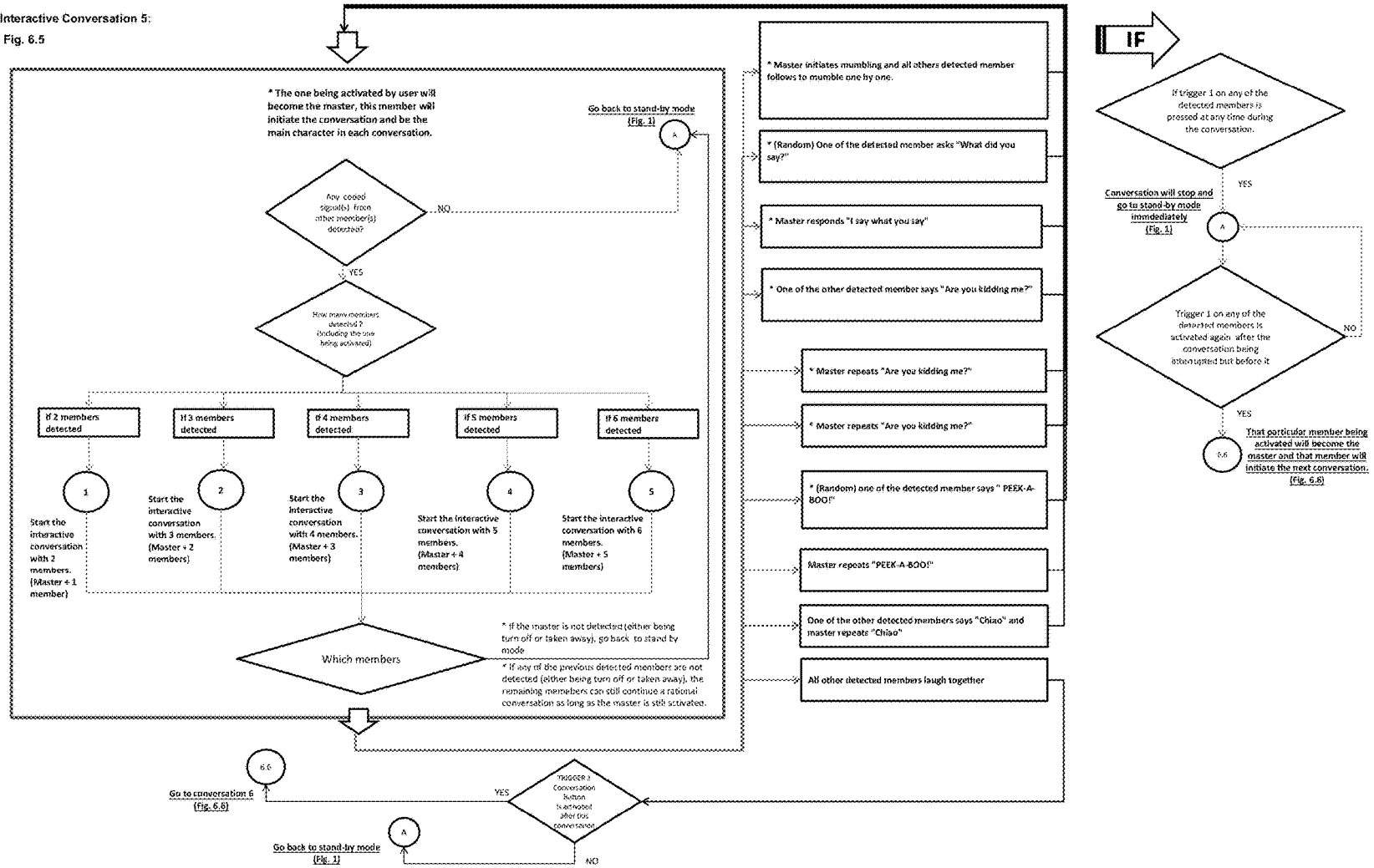
Interactive Conversation 5:
Fig. 6.5

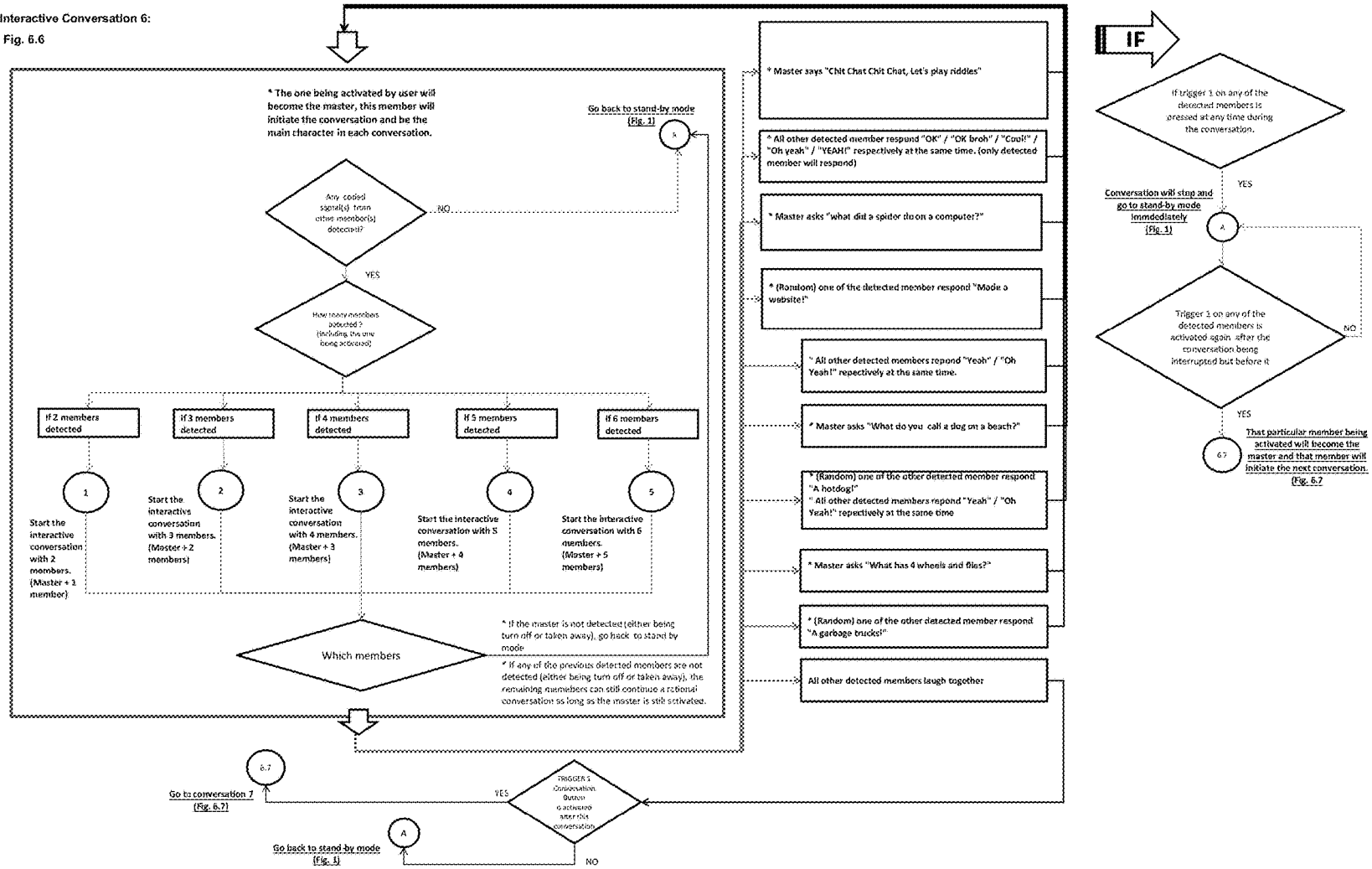
Interactive Conversation 6:
Fig. 6.6

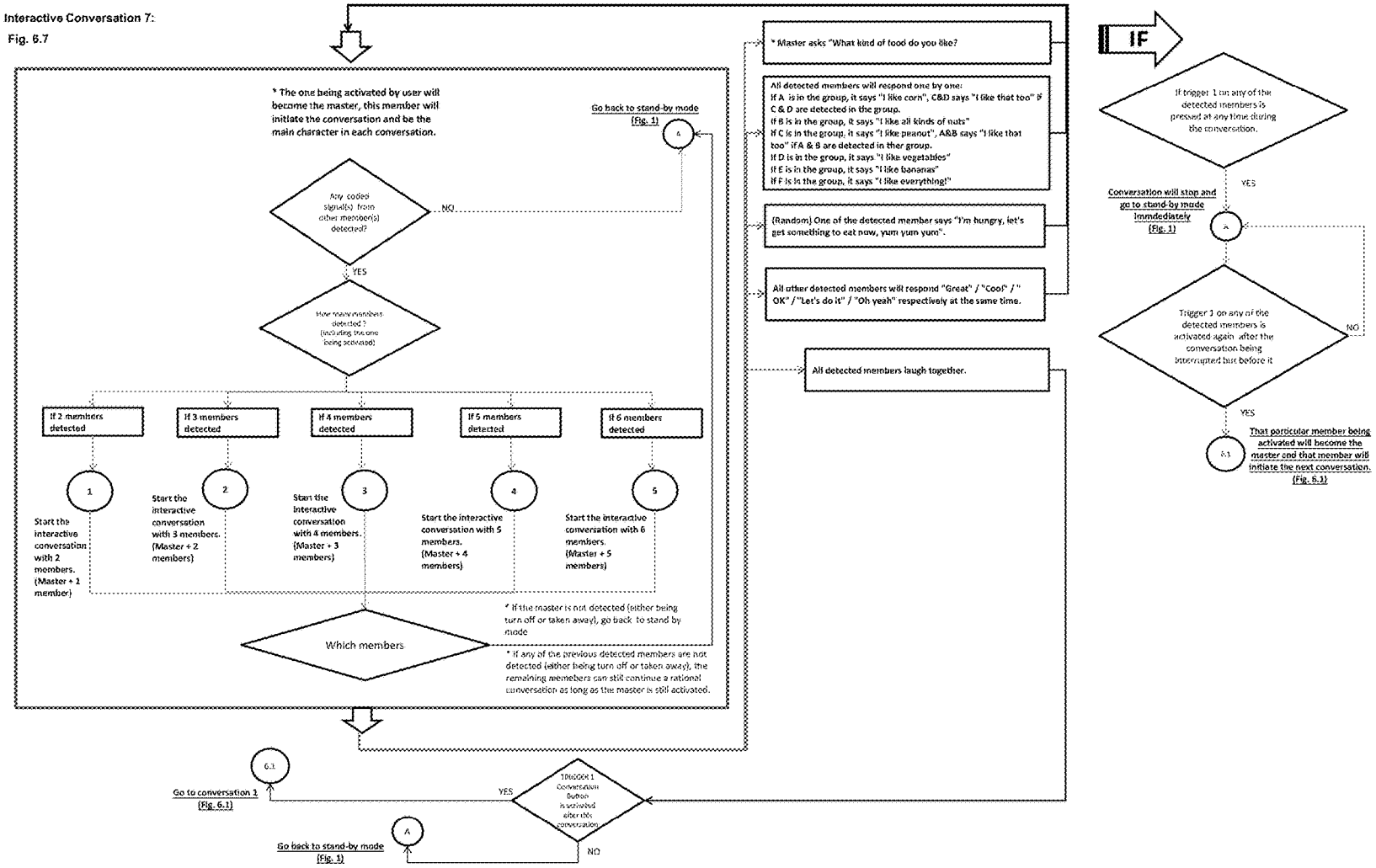
Interactive Conversation 7:
Fig. 6.7

INTERACTIVE TALKING TOY

CROSS-REFERENCE TO RELATED APPLICATIONS

This application claims the benefit of U.S. Provisional Patent Application No. 61/730,067 filed on Nov. 27, 2012, the contents of which is hereby incorporated by reference.

FIELD OF THE PATENT APPLICATION

The present patent application generally relates to consumer electronics and more specifically to an interactive talking toy.

BACKGROUND

Traditional interactive toys can typically perform single actions, such as saying a single word or phrase, singing a song or performing a single desired movement. Multiple activation switches may be used in such toys, while each switch activates the toy to perform a desired sound or movement. Once the sound and the motion are completed, the toy typically does nothing sitting there waiting for the next activation by the user.

There are some toys using IR transmission to transmit signals between 2 different objects (such as dolls). However, those toys are typically using unidirectional infrared transceivers, which means there is a transmitter in one of the toys while there is a receiver in the other toy. The communication is limited to one way only. The toy with a receiver will not respond or perform meaningful actions if it loses connection with or does not detect signals from the other toy with a transmitter.

SUMMARY

The present patent application is directed to an interactive talking toy. In one aspect, the interactive talking toy includes a plurality of toy units. Each toy unit includes: a transmitter configured to transmit a signal to the other toy units; a receiver configured to receive a signal from the other toy units; a speaker configured to output a voice; and a controller IC being connected with the transmitter, the receiver, and the speaker, and configured to set a plurality of modes for the toy unit based on the communication between the toy unit and the other toy units, and selectively control the speaker to output prerecorded phrases in a predetermined sequence along with the other toy units according to the mode being set for the toy unit and for the other toy units respectively. The controller IC is configured to check the mode being set for the other toy units at the end of each phrase, and to control the speaker to proceed with outputting the prerecorded phrases in the predetermined sequence along with toy units that are set in a predetermined mode.

The controller IC may include a ROM and a RAM for storing instructions and data, and a driver circuit for driving the speaker with a PWM signal. The toy unit may further include a microphone being connected with the controller IC and configured to acquire a voice input, and an audio codec processor being connected to the microphone and the controller IC, the audio codec processor including an ADC and a DAC, and being configured to process voice input acquired by the microphone and send the processed audio data to the controller IC. The audio codec processor may further include an auto gain control circuit and an equalizer amplifier.

The transmitter may include a light-emitting diode for emitting an infrared optical signal to the other toy units. The receiver includes a photodiode for receiving an infrared optical signal from the other toy units. The controller IC may include a motor driver configured for driving a motor, and a watch dog timer for generating a timing signal.

The prerecorded phrases may be grouped into conversations, and the controller IC may be configured to control the speaker to output the prerecorded phrases in a predetermined sequence along with the other toy units to carry on a predetermined number of conversations in a predetermined cycle.

The controller IC may be configured to set a bump heads mode for the toy unit, and to control the speaker to output a series of phrases in turn with another toy unit, the other toy unit being configured to be also set in the bump heads mode. The controller IC may be configured to set a talk back mode for the toy unit, to record a voice acquired by the microphone, to modify the pitch of the voice, and to control the speaker to output the modified voice.

The controller IC may be configured to set an interactive conversation mode for the toy unit, to detect other toy units that are also set in the same mode, and to control the speaker to output a series of phrases in turn along with those detected toy units. The controller IC may be configured to check the mode being set for the other toy units at the end of each phrase, and to control the speaker to proceed with outputting a predetermined set of conversations with toy units that are also set in the interactive conversation mode in a predetermined cycle so that the conversations are continuously carried on even if a toy unit leaves or joins an on-going conversation.

The controller IC may be configured to set a single mode for the toy unit, and to control the speaker to output a series of phrases grouped into a plurality of conversations in a cycle. The controller IC may be configured to set a reminder mode for the toy unit if the toy unit has been idled for a first predetermined time period, and to control the speaker to output a series of phrases reminding a user. The controller IC may be configured to set a sleeping mode for the toy unit if the toy unit has been idled for a second predetermined time period, and to power off the toy unit.

In another aspect, the present patent application provides a method for interactive role playing implemented by an interactive talking toy. The interactive talking toy includes a plurality of toy units. The method includes: transmitting a signal with a transmitter of a toy unit to the other toy units; receiving a signal from the other toy units with a receiver of the toy unit; outputting a voice with a speaker of the toy unit; setting a plurality of modes for the toy unit based on the communication between the toy unit and the other toy units, and selectively controlling the speaker to output prerecorded phrases in a predetermined sequence along with the other toy units according to the mode being set for the toy unit and for the other toy units respectively with a controller IC of the toy unit; and checking the mode being set for the other toy units at the end of each phrase, and controlling the speaker to proceed with outputting the prerecorded phrases in the predetermined sequence along with toy units that are set in a predetermined mode.

In the method, the prerecorded phrases may be grouped into conversations while the speaker is controlled by the controller IC to output the prerecorded phrases in a predetermined sequence along with the other toy units to carry on a predetermined number of conversations in a predetermined cycle.

The method may further include setting an interactive conversation mode for the toy unit, detecting other toy units that are also set in the same mode, and controlling the speaker to output a series of phrases in turn along with those detected toy units.

In yet another aspect, the interactive talking toy includes a plurality of toy units. Each toy unit includes: a transmitter configured to transmit a signal to the other toy units; a receiver configured to receive a signal from the other toy units; a microphone configured to acquire a voice input; a speaker configured to output a voice; and a controller IC being connected with the transmitter, the receiver, the microphone and the speaker, and configured to set a plurality of modes for the toy unit based on the communication between the toy unit and the other toy units, and selectively control the speaker to output prerecorded phrases in a predetermined sequence along with the other toy units according to the mode being set for the toy unit and for the other toy units respectively. The controller IC is configured to check the mode being set for the other toy units at the end of each phrase, and to control the speaker to proceed with outputting the prerecorded phrases in the predetermined sequence along with toy units that are set in a predetermined mode. The controller IC is configured to set a talk back mode for the toy unit, to record a voice acquired by the microphone, to modify the pitch of the voice, and to control the speaker to output the modified voice. The controller IC is further configured to set an interactive conversation mode for the toy unit, to detect other toy units that are also set in the same mode, and to control the speaker to output a series of phrases in turn along with those detected toy units.

BRIEF DESCRIPTIONS OF THE DRAWINGS

Figure 1A:
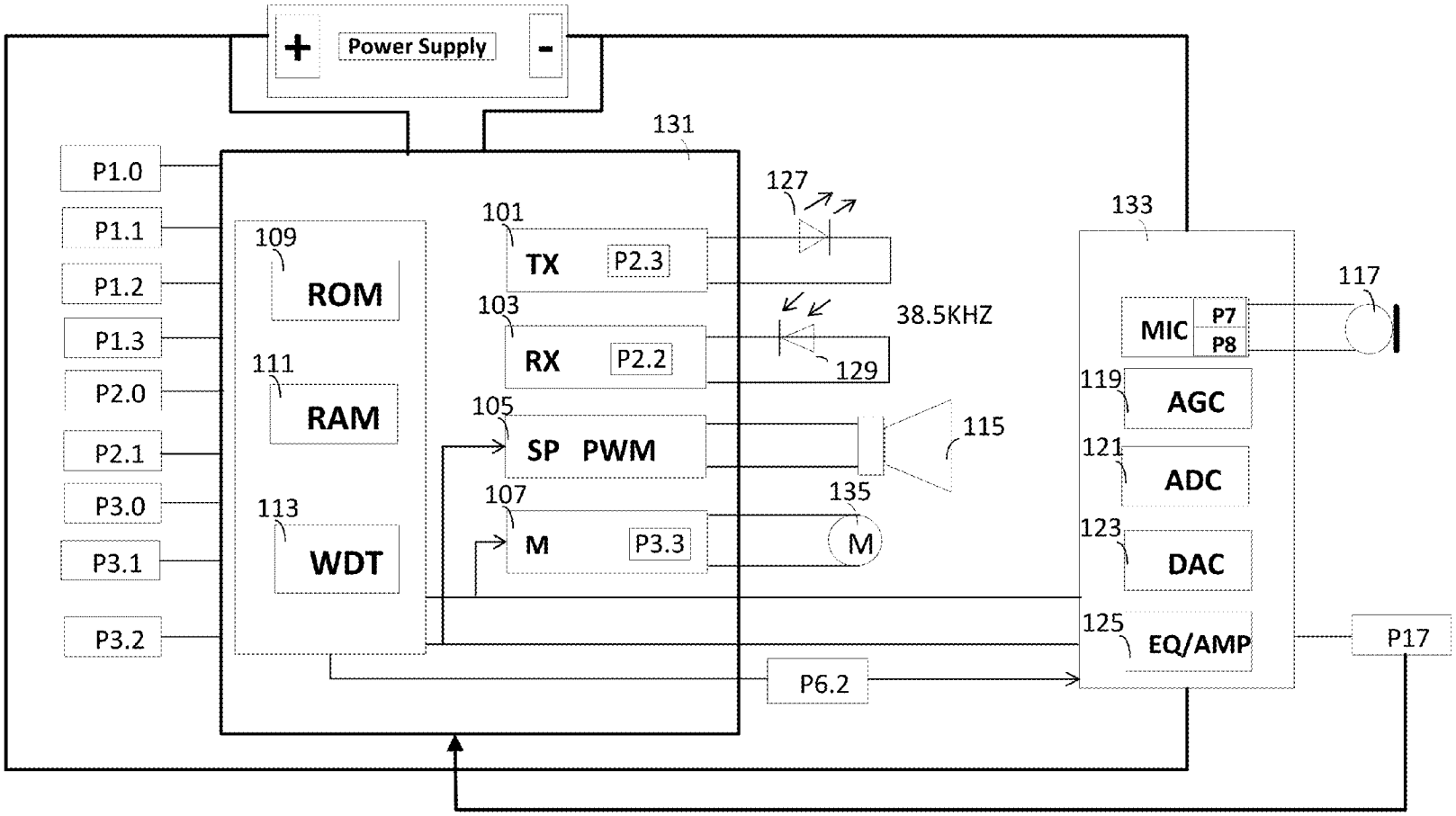
FIG. 1A is a schematic circuit diagram of a toy unit in an embodiment of the present patent application.

FIG. 6.1 is a flow chart illustrating interactive conversation 1.

FIG. 6.2 is a flow chart illustrating interactive conversation 2.

FIG. 6.3 is a flow chart illustrating interactive conversation 3.

FIG. 6.4 is a flow chart illustrating the interactive conversation 4.

FIG. 6.5 is a flow chart illustrating interactive conversation 5.

FIG. 6.6 is a flow chart illustrating interactive conversation 6.

FIG. 6.7 is a flow chart illustrating interactive conversation 7.

Figure 7:
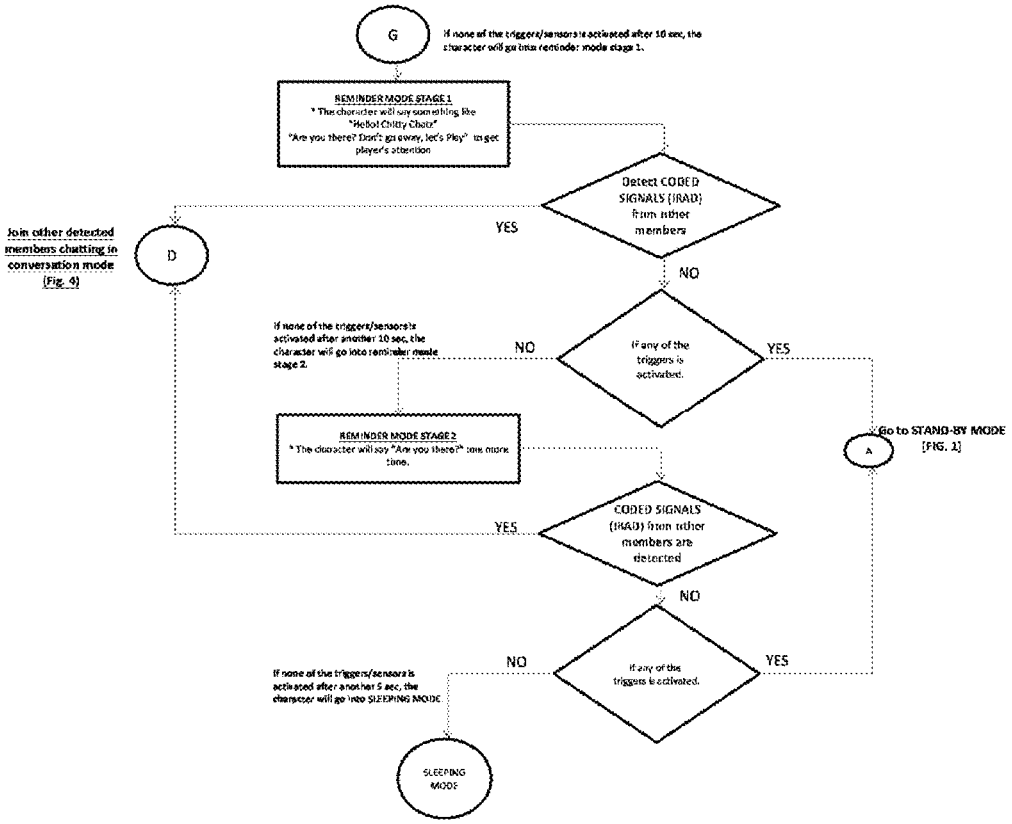

FIG. 7 is a flow chart illustrating the reminder mode of a toy unit.

DETAILED DESCRIPTION

Reference will now be made in detail to a preferred embodiment of the interactive talking toy disclosed in the present patent application, examples of which are also provided in the following description. Exemplary embodiments of the interactive talking toy disclosed in the present patent application are described in detail, although it will be apparent to those skilled in the relevant art that some features that are not particularly important to an understanding of the interactive talking toy may not be shown for the sake of clarity.

Furthermore, it should be understood that the interactive talking toy disclosed in the present patent application is not limited to the precise embodiments described below and that various changes and modifications thereof may be effected by one skilled in the art without departing from the spirit or scope of the protection. For example, elements and/or features of different illustrative embodiments may be combined with each other and/or substituted for each other within the scope of this disclosure.

According to an embodiment of the present patent application, an interactive talking toy includes a plurality of toy units. Each toy unit includes: a transmitter configured to transmit a signal to the other toy units; a receiver configured to receive a signal from the other toy units; a microphone configured to acquire a voice input; a speaker configured to output a voice; a controller IC being connected with the transmitter, the receiver, the microphone and the speaker, and configured to set a plurality of modes for the toy unit based on the communication between the toy unit and the other toy units, and selectively control the speaker to output prerecorded phrases in a predetermined sequence with the other toy units according to the mode being set for the toy unit and for the other toy units respectively.

FIG. 1A is a schematic circuit diagram of a toy unit in this embodiment. Referring to FIG. 1A, the toy unit includes a transmitter 101, a receiver 103, a microphone 117, a speaker 115, and a controller IC 131. In this embodiment, the transmitter 101 and the receiver 103 are integrated with the controller IC and located within the same chip package with the controller IC 131.

In this embodiment, the controller IC 131 includes a ROM 109 and a RAM 111 for storing instructions and data, and a driver circuit 105 for driving the speaker 115 with a PWM signal. The toy unit further includes an audio codec processor 133 being connected to the microphone 117 and the controller IC 131. The audio codec processor 133 includes an ADC 121 and a DAC 123, and is configured to process voice input acquired by the microphone 117 and send the processed audio data to the controller IC 131. The audio codec processor 133 further includes an automatic gain control circuit (AGC) 119 and an equalizer amplifier 125.

The transmitter 101 includes a light-emitting diode 127 for emitting an infrared optical signal to the other toy units, and the receiver 103 includes a photodiode 129 for receiving an infrared optical signal from the other toy units. It is understood that the transmitter 101 and the receiver 103 may be configured to transmit and receive other type of communication signals such as RF signals. The controller IC 131 includes a motor driver 107 configured for driving a motor 135, and a watch dog timer 113 for generating a timing signal.

In this embodiment, a set of toy units are provided to be able to operate individually or interact with each other. The interaction is designed for various combinations. They can either be interacting with each other in a group of 2 characters, 3 characters, 4 characters, 5 characters or 6 characters. If no other characters are detected when the character is activated, that character will go into a single mode and perform desired phrases/sound/action/movement programmed for the single mode operation. In single mode operation, the character will perform various groups of actions simulating a character talking to the user or itself. At the end of each phrase, the character will emit and detect coded signals to check if there are other characters around so they can either join the conversation or switch to a group chatting conversation mode. In other words, the controller IC 131 is configured to check the mode being set for the other toy units at the end of each phrase, and to control the speaker to proceed with outputting a preset conversation with toy units that are set in a predetermined mode.

Referring to FIG. 1A, the controller IC 131 has a plurality of pins such as P1.0, P1.1, P1.2 and etc. Similarly, the transmitter 101 has a pin P2.3 while the receiver 103 has a pin P2.2. In the description hereafter, if a pin, for example P1.0, is set at a high voltage, the condition will be denoted as P1.0=H; if the pin is set at a low voltage, the condition will be denoted as P1.0=L.

Figure 1B:
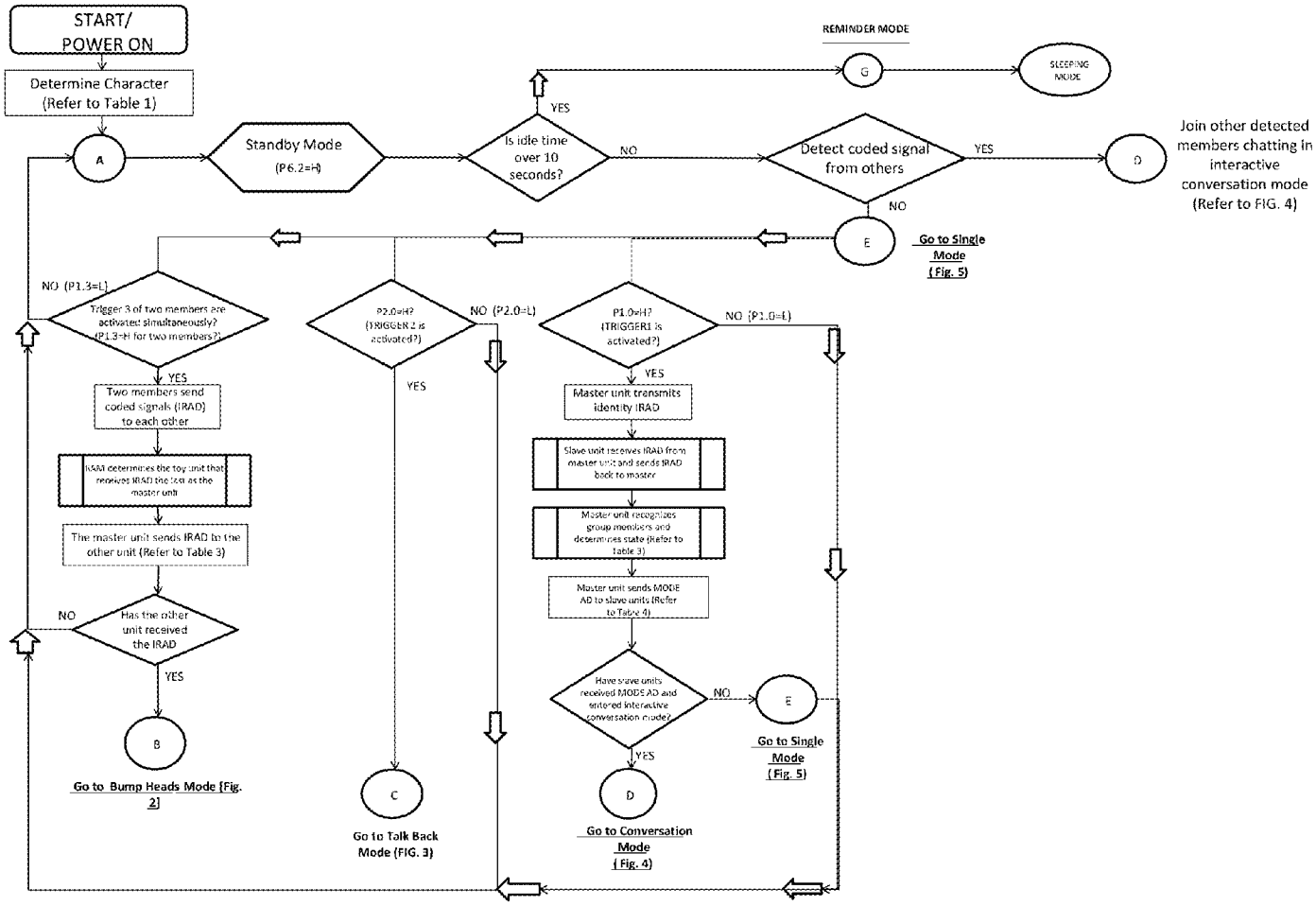
FIG. 1B is a flow chart illustrates the overall operation of an interactive talking toy according to an embodiment of the present patent application.

FIG. 1B is a flow chart illustrates the overall operation of the interactive talking toy. When the device is power ON, it will go into stand-by mode automatically. Each toy unit will determine the character it takes with the rule set in Table 1.

TABLE 1

| | 1 | 2 | 3 | 4 | 5 | 6 | 7 | 8 |
|---|---|---|---|---|---|---|---|---|
| IO | TOOKIE | ZEZEE | HEWY | 0-BOY | BOINKY | KOKEY | Reserved For Other Characters | |
| MEMBER | A | B | C | D | E | F | | |
| P3.0 | H | H | H | H | L | L | L | L |
| P3.1 | H | H | L | L | H | H | L | L |
| P3.2 | H | L | H | L | H | L | L | H |

For example, if P3.0=H, P3.1=H, and P3.2=H, the toy unit takes the character of Tookie.

Table 2 is a definition table of the triggers.

| IO | P1.0 | P1.1 | P1.2 | P1.3 | P2.0 |
|---|---|---|---|---|---|
| TRIGGER | 1 | | | 3 | 2 |
| Logic Voltage | H | H | H | H | H |
| Definition | IR conversation | Pull hair activation (optional feature) | Burping (optional feature) | IR-bumping heads | Talk back |

In stand-by mode (P6.2=H), every single character emits and detects coded signals to search other characters within the detectable range. If they have detected signals from other member(s) and confirmed to start a conversation initiated by a 'master' character, they will all go into the group chatting conversation mode and chatting with other detected members.

Figure 2:
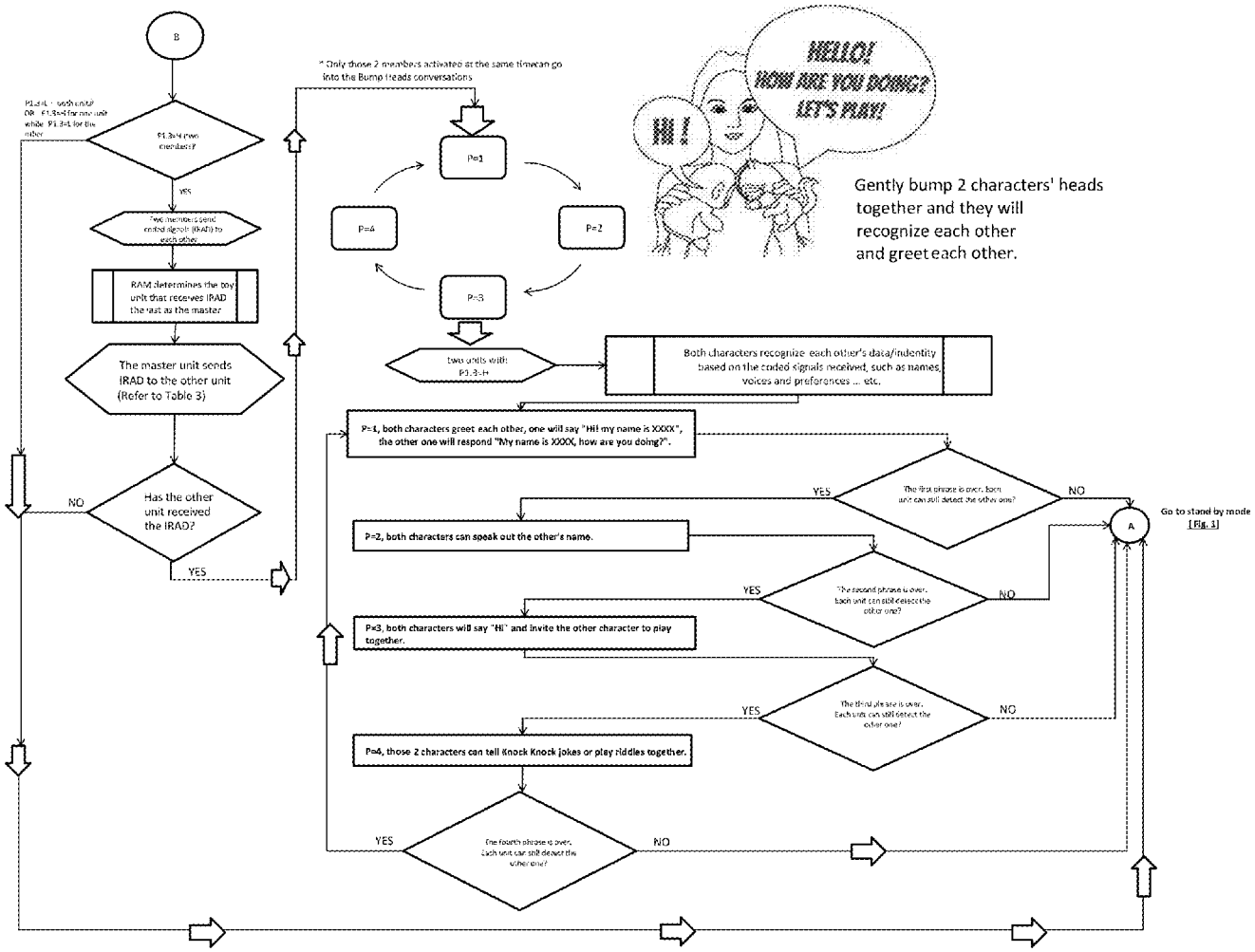
FIG. 2 is a flow chart illustrating a toy unit's operation in the Bump Heads Mode.

If 2 characters are head-bumped by the user, trigger 3 (bump heads sensors) on both characters should have been activated at the same time or within a short tolerance of time; both characters emit signals that carry codes indicating the time of the sensor being activated and their own identity codes. If both characters received the codes with the same activation time or within the acceptable tolerance, then those 2 characters will go into bump heads mode, as illustrated in FIG. 2.

Figure 4:
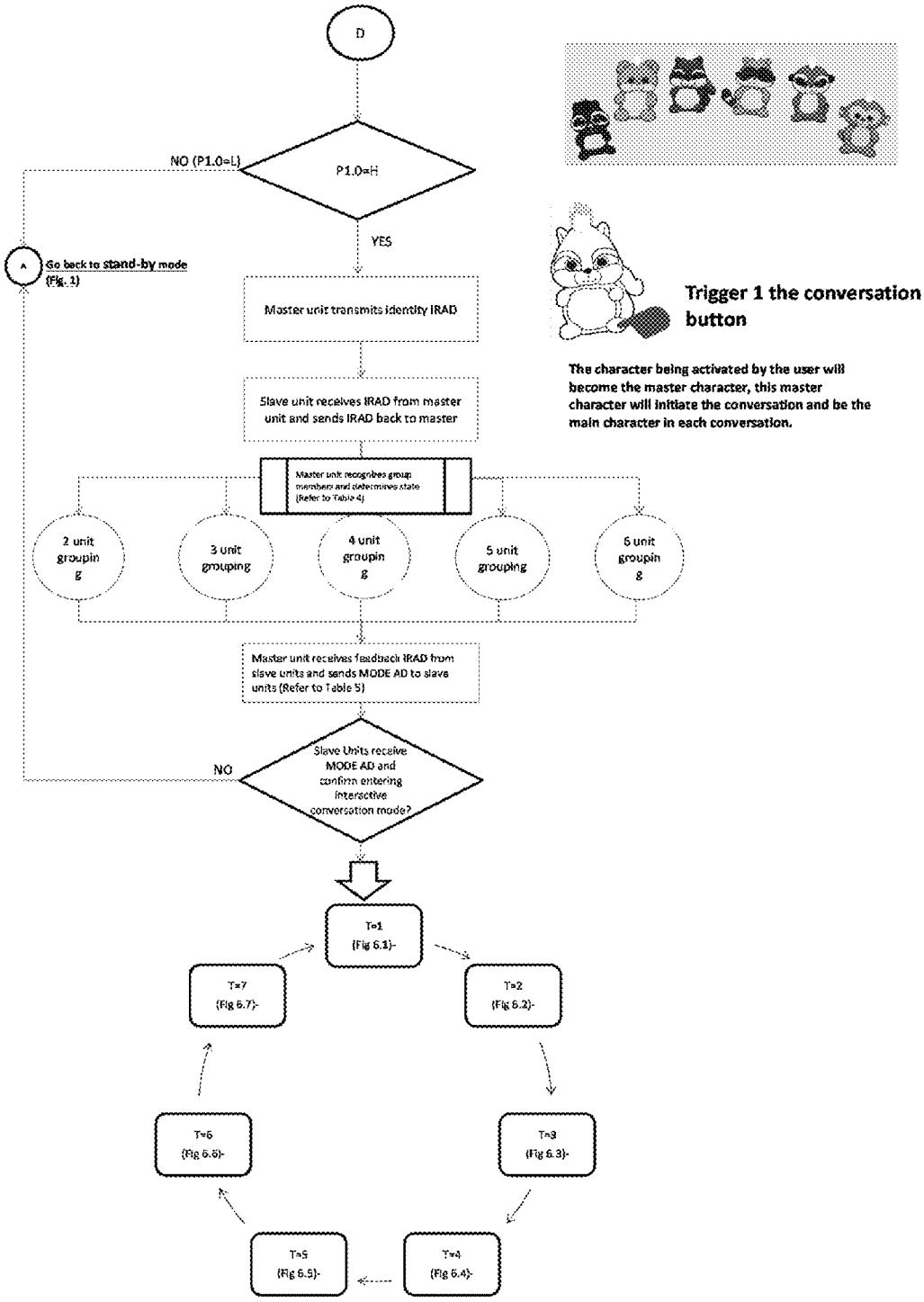
FIG. 4 is a flow chart illustrating a toy unit's operation in the interactive conversation mode.

If trigger 1 (conversation button) on a character is activated and it detected signals from other member(s), all detected members will go into conversation mode immediately, the character being activated by user will become the 'master' to initiate the conversation, as illustrated in FIG. 4.

Figure 5:
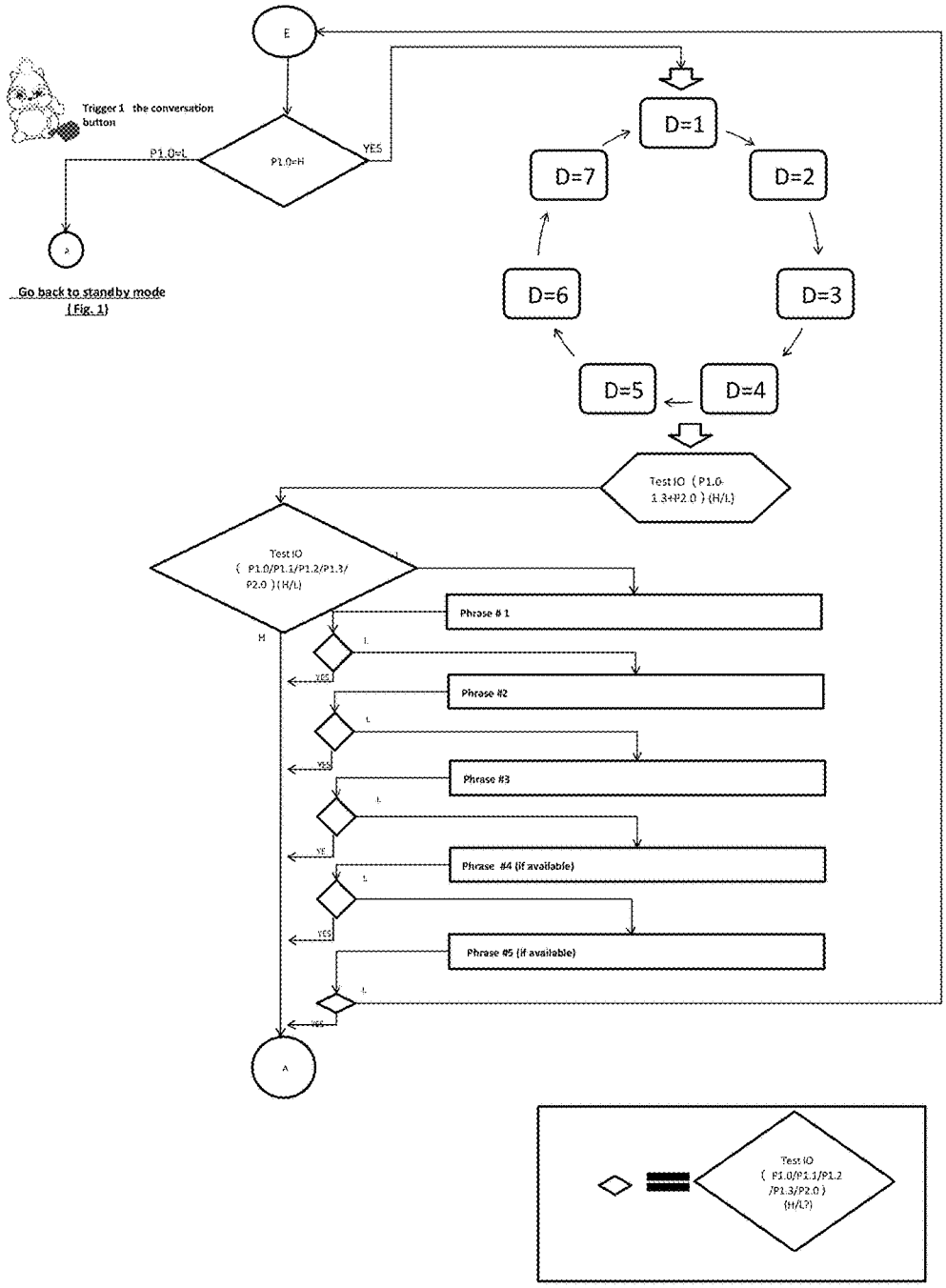
FIG. 5 is a flow chart illustrating a toy unit's operation in the single mode.

If trigger 1 (conversation button) on a character is activated but it can't detect any signals from other member(s), that character will go into Single Mode, as illustrated in FIG. 5.

Figure 3:
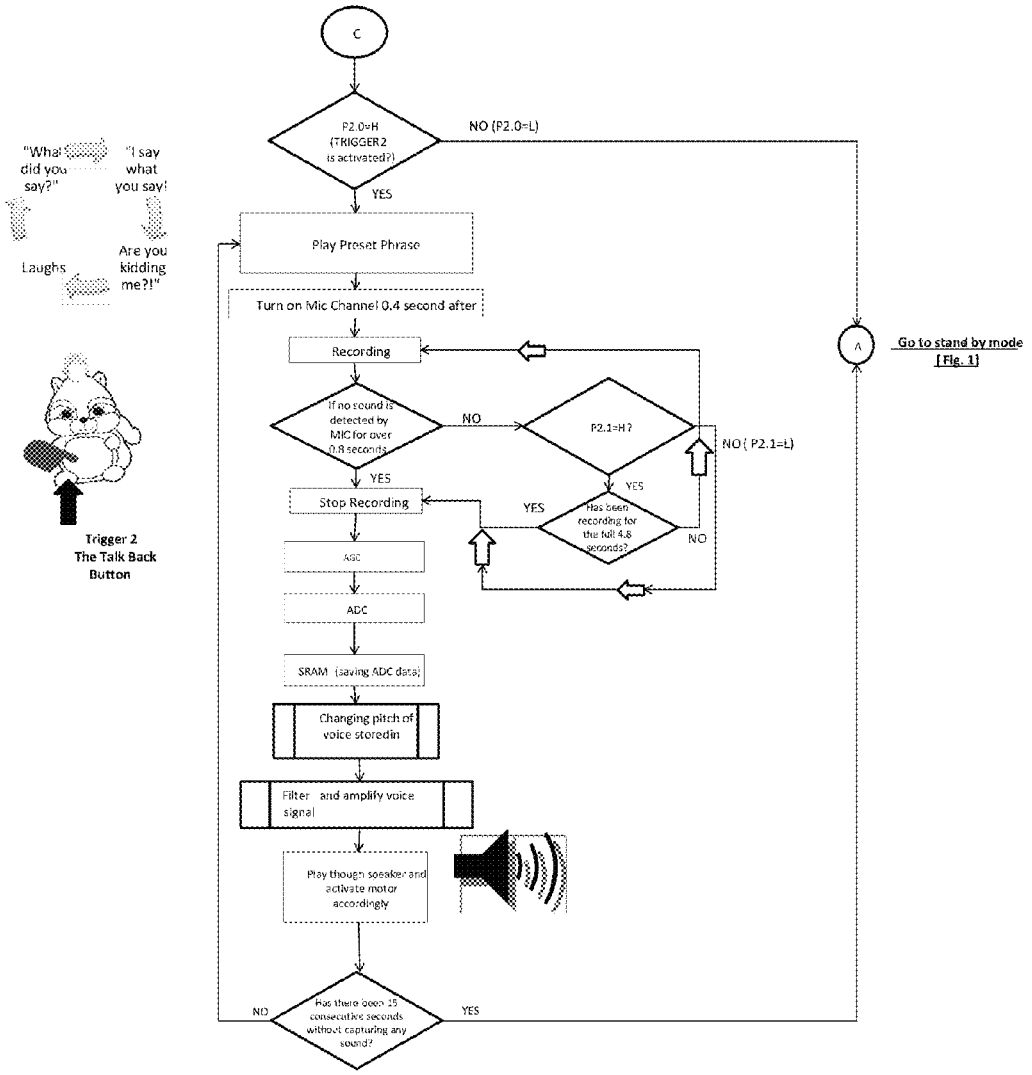
FIG. 3 is a flow chart illustrating a toy unit's operation in the Talk Back Mode.

If trigger 2 (talk back button) is activated, that character will go into talk back mode, as illustrated in FIG. 3. If the character has been idled for over 10 seconds, it means none of the triggers/sensors has been activated by user or it has not been able to detect any signals from other members. After 10 seconds, that character will go into Reminder Mode, as illustrated in FIG. 7. If none of the triggers/sensors is being activated after reminder mode, the character will go into sleeping mode to preserve battery. The detailed configurations such as pin voltages and conditions for the toy unit to enter each mode as aforementioned are described in FIG. 1B.

FIG. 2 is a flow chart illustrating a toy unit's operation in the Bump Heads Mode. Referring to FIG. 2, only 2 characters can go into bump heads mode at a time. If 2 characters are head-bumped by user, the bump heads sensors (trigger 3) on both characters should be activated at the same time or within a short tolerance of time. Both characters emit signals that carry codes indicating the time of the sensor being activated as well as their own identity codes. If both characters received the codes with the same activation time or within the acceptable tolerance range, then those 2 characters are confirmed to continue the bump heads greeting conversations. If not, they will both stay in stand-by mode.

There are 4 different sets of bump head conversations, both confirmed bump heads characters will go through one set of conversation at each activation. In bump heads conversation 1, both characters greet each other, one will say "My name is XXX" and the other will respond "My name is XXX". For example, if A and B are activated in the bump heads mode, A will say "My name is A" and then B will say "My name is B". In bump heads conversation 2, both characters recognized each other's identity and speak out their names respectively. For example, if A&B are activated, A will say "Hi B!" and B will say "Hi A!" In bump heads conversation 3, both characters will say "Hi" at the same time, after that one of the characters will say "Let's play!" In bump heads conversation 4, both characters will play "Knock Knock Jokes" or play riddles. For example, A says "Knock Knock", B responds "Who's there?", then A says "HAWAII", B responds "HAWAII who?", then A says "I'm fine, HAWAII you!" It is understood that the content of the bump heads conversation should not be limited to the above mentioned content.

Referring to FIG. 2, when two members send coded signals (IRAD) to each other, the controller IC (the RAM thereof) is configured to determine the toy unit that receives IRAD the last as the master unit. The master unit then sends IRAD to the other unit according to Table 3. Table 3 is a partial IRAD code list.

TABLE 3

| | | | | | | | | | | | | | | | | | |
|---|---|---|---|---|---|---|---|---|---|---|---|---|---|---|---|---|---|
| 0 | 0 | AD1 | 1 | 0 | AD17 | 2 | 0 | AD33 | 3 | 0 | AD49 | 4 | 0 | AD65 | 5 | 0 | AD81 |
| 0 | 1 | AD2 | 1 | 1 | AD18 | 2 | 1 | AD34 | 3 | 1 | AD50 | 4 | 1 | AD66 | 5 | 1 | AD82 |
| 0 | 2 | AD3 | 1 | 2 | AD19 | 2 | 2 | AD35 | 3 | 2 | AD51 | 4 | 2 | AD67 | 5 | 2 | AD83 |
| 0 | 3 | AD4 | 1 | 3 | AD20 | 2 | 3 | AD36 | 3 | 3 | AD52 | 4 | 3 | AD68 | 5 | 3 | AD84 |
| 0 | 4 | AD5 | 1 | 4 | AD21 | 2 | 4 | AD37 | 3 | 4 | AD53 | 4 | 4 | AD69 | 5 | 4 | AD85 |
| 0 | 5 | AD6 | 1 | 5 | AD22 | 2 | 5 | AD38 | 3 | 5 | AD54 | 4 | 5 | AD70 | 5 | 5 | AD86 |
| 0 | 6 | AD7 | 1 | 6 | AD23 | 2 | 6 | AD39 | 3 | 6 | AD55 | 4 | 6 | AD71 | 5 | 6 | AD87 |
| 0 | 7 | AD8 | 1 | 7 | AD24 | 2 | 7 | AD40 | 3 | 7 | AD56 | 4 | 7 | AD72 | 5 | 7 | AD88 |
| 0 | 8 | AD9 | 1 | 8 | AD25 | 2 | 8 | AD41 | 3 | 8 | AD57 | 4 | 8 | AD73 | 5 | 8 | AD89 |
| 0 | 9 | AD10 | 1 | 9 | AD26 | 2 | 9 | AD42 | 3 | 9 | AD58 | 4 | 9 | AD74 | 5 | 9 | AD90 |
| 0 | A | AD11 | 1 | A | AD27 | 2 | A | AD43 | 3 | A | AD59 | 4 | A | AD75 | 5 | A | AD91 |
| 0 | B | AD12 | 1 | B | AD28 | 2 | B | AD44 | 3 | B | AD60 | 4 | B | AD76 | 5 | B | AD92 |
| 0 | C | AD13 | 1 | C | AD29 | 2 | C | AD45 | 3 | C | AD61 | 4 | C | AD77 | 5 | C | AD93 |
| 0 | D | AD14 | 1 | D | AD30 | 2 | D | AD46 | 3 | D | AD62 | 4 | D | AD78 | 5 | D | AD94 |
| 0 | E | AD15 | 1 | E | AD31 | 2 | E | AD47 | 3 | E | AD63 | 4 | E | AD79 | 5 | E | AD95 |
| 0 | F | AD16 | 1 | F | AD32 | 2 | F | AD48 | 3 | F | AD64 | 4 | F | AD80 | 5 | F | AD96 |

If the other unit receives the IRAD, then the toy units enter the bump heads mode. It is further noted that at the end of each phrase, the system will check if each unit can still detect the other one before proceeding with the next phrase.

FIG. 3 is a flow chart illustrating a toy unit's operation in the Talk Back Mode. Referring to FIG. 3, when trigger 2 (the talk back switch) on a character is activated by user, that character will go into talk back mode. The character says "What did you say?"/"I say what you say"/Are you kidding me?" or laughs randomly before recording sound. If any sound detected by the built-in microphone, the character will start recording until the sound stops or after the maximum recording time which is about 4.8 seconds to 6 seconds, the controller IC (integrated circuit) will change the pitch of the recorded sound and playback the pitched sound through the speaker.

The character will go back to stand-by mode automatically if the microphone has not been able to detect any sound after 15 seconds. Any other activations will quit the talk back mode. For example, the character will go into conversation mode if trigger 1 (the conversation activation) is activated by user when the character is in the talk back mode. The detailed voltage configurations of the pins, the timing control, and how various parts in the controller IC and the audio codec processor work in this mode are illustrated in FIG. 3.

FIG. 4 is a flow chart illustrating a toy unit's operation in the interactive conversation mode. Referring to FIG. 4, when the trigger 1 (the conversation button) on a character is activated, that character will emit and detect signals from others frequently, basically after each phrase. All activated characters will do the same once they are activated. If there is/are other character(s) detected, the one being activated by the user will become the master, this 'master' character will initiate the conversation or be the main character in each conversation. After that, each activated character will detect and confirm how many characters are detected before continue the conversation.

If there are 2 members detected, those 2 characters will go into the interactive conversation mode with 2 members only. If there are 3 members detected, those 3 characters will go into the interactive conversation mode with 3 members only. If there are 4 members detected, those 4 characters will go into the interactive conversation mode with 4 members only. If there are 5 members detected, those 5 characters will go into the interactive conversation mode with 5 members only. If there are 6 members detected, those 6 characters will go into the interactive conversation mode with 6 members.

Initially, there are 7 different sets of interactive conversations, as illustrated by FIGS. 6.1-6.7. Each activation on the master character will activate the next interactive conversation. All detected members will follow to cycle through the 7 conversations sequentially if trigger 1 the conversation button on the master character has been activating by user at the end of each conversation. In each interactive conversation, the number of group chatting members can be freely changed as long as the master character is not being removed or turned power OFF.

For example, there are 3 members detected (A, B and C), so those 3 members are joining the interactive conversation initiated by the master (A). At the end of each phrase, each character emits and detects coded signals. After the 2nd phrase of conversation 1, B has been removed, so A and C detect codes showing there are only 2 members left in the group. A and C will continue the 3rd phrase of conversation 1 with 2 members only. After the 3rd phrase, D and E have been turned ON and detected by A and C, so those 4 detected members (A, C, D, E) will continue with the 4th phrase of conversation 1, so on and so forth.

TABLE 4

| 1 unit | 2 units | 3 units | 4 units | 5 units | 6 units |
|---|---|---|---|---|---|
| 1 | 12 | 123 | 1234 | 12345 | 123456 |
| 2 | 13 | 124 | 1235 | 12346 | |
| 3 | 14 | 125 | 1236 | 12356 | |
| 4 | 15 | 126 | 1245 | 12456 | |
| 5 | 16 | 134 | 1246 | 13456 | |
| 6 | 23 | 135 | 1256 | 23456 | |
| | 24 | 136 | 1345 | | |
| | 25 | 145 | 1346 | | |
| | 26 | 146 | 1356 | | |
| | 34 | 156 | 1456 | | |
| | 35 | 234 | 2345 | | |
| | 36 | 235 | 2346 | | |
| | 45 | 236 | 2356 | | |
| | 46 | 245 | 2456 | | |
| | 56 | 246 | 3456 | | |
| | | 256 | | | |
| | | 345 | | | |
| | | 346 | | | |
| | | 356 | | | |
| | | 456 | | | |

Table 4 is a list of all possible combinations of group members. Referring to FIG. 4, after the master unit and the slave unit (i.e. the group members other than the master unit) send IRAD to each other, the master unit recognizes the group members and determines a state listed in Table 4.

TABLE 5

| MODE | Conversation 1 | Conversation 2 | Conversation 3 | Conversation 4 | Conversation 5 | Conversation 6 | Conversation 7 |
|---|---|---|---|---|---|---|---|
| Single | D = 1 | D = 2 | D = 3 | D = 4 | D = 5 | D = 6 | D = 7 |
| Interactive Conversation | T = 1 | T = 2 | T = 3 | T = 4 | T = 5 | T = 6 | T = 7 |
| Bump heads | P = 1 | P = 2 | P = 3 | P = 4 | P = 5 | P = 6 | P = 7 |
| Sleep | S = 1 | S = 2 | S = 3 | S = 4 | S = 5 | S = 6 | S = 7 |

Table 5 is a list of Mode AD. Referring to FIG. 4, the master unit receives feedback IRAD from slave units and sends MODE AD to slave units (Refer to Table 5). The slave units receive MODE AD and confirm entering the interactive conversation mode.

FIG. 5 is a flow chart illustrating a toy unit's operation in the single mode. Referring to FIG. 5, the character will go into single mode conversation if trigger 1 (the conversation button) is activated but no other members detected. Each activation on trigger 1 of this character will activate one set of conversation, the next activation will activate the next set of conversation (there are 7 different sets of the single mode conversations including but not limited to). At the end of each phrase in each conversation, the character will emit and detect signals from others. The toy unit will quit single mode conversation and go into interactive conversation mode if other members are detected. If any of other activation switches is activated during the single mode conversation, the character will go into different operation mode accordingly. For example, the character will go into talk back mode when trigger 2 the talk back switch is activated by user, so on and so forth. The detailed pin voltage configurations are illustrated in FIG. 5.

FIG. 6.1 is a flow chart illustrating Interactive Conversation 1. The character being activated by user will become the master character of this conversation. The character will emit and detect coded signals from others. The other stand-by characters will also emit and detect coded signals from others. Once they confirm there is/are other member(s) within the detectable range, they will also detect how many members are within the detectable range and confirm their identity based on the codes they received. The process of emit and detect signals, confirming number of detected members and identifying the detected member is defined as the scanning process (FIG. 6A). This process will be performed frequently, basically after each phrase in the conversation.

For example, trigger 1 on character A is activated by the user and there are 2 other members (B and C) detected, those 3 members (A, B, C) will start this conversation initiated by A, because A has become the 'master' character in this conversation. so master character A will say "Hello Chitty Chatz! my name is A" (then all characters perform the scanning process to confirm if there's any change of status). If no changes detected, B and C will respond one by one, B will say "my name is B" and C will say "my name is C"; At the end of this phrase, all characters will perform the scanning process to confirm the latest chatting environment/status.

If one more character D is detected and they will all continue the 2nd phrase with 4 members (A, B, C, D) initiated by the master character A. Master character A will then say "Let's play!", (then all characters perform the scanning process to confirm if there's any change of status). If no changes detected, then all other detected members respond at the same time, B says "OK!", C says "Cool!", D says "OK broh!"

At the end of this phrase, all characters will perform the scanning process to confirm the latest chatting environment/status. If two more characters (E and F) are detected, then all 6 detected members (A, B, C, D, E, F) will continue the 3rd phrase with 6 members. A is still the master character, but A is not going to initiate the conversation this time, one of the other members (B/C/D/E/F) can be the one who asks the question, randomly F is being chosen by the program to be the character asking this time, it will say "what are we going to do now?", (then all characters perform the scanning process to confirm if there's any change of status). If no changes detected, then randomly one of the other 5 members (A/B/C/D/E) will respond, this time B is the character randomly chosen to respond "Guest what?! Let's go skate-boarding!" At the end of this phrase, all characters will perform the scanning process to confirm the latest chatting environment/status.

In case of B and D are being removed or power OFF, so there are only 4 other members detected (A, C, E, F), then all 4 detected members will continue this conversation with 4 members only; Randomly C is chosen to say "ACHOO!", (then all characters perform the scanning process to confirm if there's any change of status). If no changes detected, then one of the other 3 detected members (A/E/F) will respond, randomly F is the one to respond this time, so F will say "Are you OK?", (then all characters perform the scanning process to confirm if there's any change of status). If no changes detected, then C will respond "Yeah! I'm OK" because C is the one who just said "ACHOO!" (then all characters perform the scanning process to confirm if there's any change of status). If no changes detected, then one of the other detected members (A/E/F) will respond, E is the one this time, so E will say "So you will be OK".

After that, the master character (A) will lead to the next interactive conversation (see FIG. 6.2) if trigger 1 conversation switch is activated by the user again. If trigger 1 is not being activated by user, all characters will be in stand-by mode. In case of trigger 1 on any of the detected members is pressed at any time during the conversation, interactive conversation will be interrupted/stopped immediately.

FIG. 6.2 is a flow chart illustrating interactive conversation 2. The character being activated by user will become the master character of this conversation. The character will emit and detect coded signals from others. The other stand-by characters will also emit and detect coded signals from others. Once they confirm there is/are other member(s) within the detectable range, they will also detect how many members are within the detectable range and confirm their identity based on the codes they received. The process of emit and detect signals, confirming number of detected members and identifying the detected member is defined as the scanning process (FIG. 6A), this process will be performed frequently, basically after each phrase in the conversation.

For example, trigger 1 on character A is activated by user and there are 2 other members (B and C) detected, those 3 detected members (A, B, C) will start this conversation initiated by A, because A has become the 'master' character in this conversation. so master character A will say "Chit Chat, Chit Chat!" (then all characters perform the scanning process to confirm if there's any change of status). If no changes detected, one of the other detected characters will respond (either B or C), this time B will respond "Chit Chit Chatz!" (then all characters perform the scanning process to confirm if there's any change of status). If no changes detected, master A will say "Whatzzup?!" (then all characters perform the scanning process to confirm if there's any change of status). If no changes detected, one of the other detected characters will respond (either B or C), this time C will respond "WhatZZUP?!" At the end of this phrase, all characters will perform the scanning process to confirm the latest chatting environment/status.

If one more character D is detected and they will all continue the 2nd phrase with 4 members (A,B,C,D) initiated by the master character A. Master character A says "He he he", (then all characters perform the scanning process to confirm if there's any change of status). If no changes detected, then one of the other detected members respond immediately, this time D will respond "Ha Ha Ha!" At the end of this phrase, all characters will perform the scanning process to confirm the latest chatting environment/status.

If character D has been removed or power OFF, then all remaining 3 detected members (A,B,C) will continue the 3rd phrase with 3 members only. Master A says "He He He, Ha Ha Ha, heee", (then all characters perform the scanning process to confirm if there's any change of status). If no changes detected, then randomly one of the other 3 members (A/B/C) will respond, this time B is the character randomly chosen to respond "where are my friends? are you there?"; (then all characters perform the scanning process to confirm if there's any change of status). If no changes detected, all other detected characters (A,C) will then respond "Yes I am here"/"Yeah Dude"/"Yes" respectively at the same time; In this case, A and C are the only 2 other detected characters, so A will respond "Yes I am here" and C will respond "Yeah Dude", no other character will respond "Yes" because there isn't any other character detected. At the end of this phrase, all characters will perform the scanning process to confirm the latest chatting environment/status.

If 3 more characters detected (D, E, F), all 6 members detected (A, B, C, D, E, F) will continue this conversation with 6 members; Randomly C is chosen to say "Let's play riddles!", (then all characters perform the scanning process to confirm if there's any change of status). If no changes detected, then all other 5 detected members will respond "OK"/"OK broh"/"Cool!"/"Oh Yeah!"/"Yeah" respectively at the same time; in this case, A,B,D,E,F, are the other detected members, so A will respond "OK", B will respond "OK broh", D will respond "Cool!", E will respond "Oh Yeah!" and F will respond "Yeah" (then all characters perform the scanning process to confirm if there's any change of status). If no changes detected, since C initiated the action of playing riddles, so C became the temporally master of this conversation and C will ask "what sound does a cat make?" (then all characters perform the scanning process to confirm if there's any change of status). If no changes detected, then one of the other detected members (A/B/D/E/F) will respond "MEOW", B is randomly chosen to say "MEOW" (then all characters perform the scanning process to confirm if there's any change of status). If no changes detected, C continues to ask "What sound does a dog make?", (then all characters perform the scanning process to confirm if there's any change of status). If no changes detected, then one of the other detected members (A/B/D/E/F) will respond "RUFF! RUFF!"; D is randomly chosen to say "RUFF! RUFF!" (then all characters perform the scanning process to confirm if there's any change of status). If no changes detected, C continues to ask "What sound does Chitty Chatz makes?" (then all characters perform the scanning process to confirm if there's any change of status). If no changes detected, then one of the other detected members (A/B/D/E/F) will respond "Chit Chat Chit Chat", F is randomly chosen to say "Chit Chat Chit Chat" (then all characters perform the scanning process to confirm if there's any change of status). If no changes detected, all detected members laugh together.

After that, character A becomes the master again, the master character will lead to the next interactive conversation (see FIG. 6.3) if trigger 1 conversation switch is activated by the user again. If trigger 1 is not being activated by user, all characters will be in stand-by mode. In case of trigger 1 on any of the detected members is pressed at any time during the conversation, interactive conversation will be interrupted/stopped immediately.

FIG. 6.3 is a flow chart illustrating interactive conversation 3. The character being activated by user will become the master character of this conversation. The character will emit and detect coded signals from others. The other stand-by characters will also emit and detect coded signals from others. Once they confirm there is/are other member(s) within the detectable range, they will also detect how many members are within the detectable range and confirm their identity based on the codes they received. The process of emit and detect signals, confirming number of detected members and identifying the detected member is defined as the scanning process (FIG. 6A), this process will be performed frequently, basically after each phrase in the conversation.

For example, trigger 1 on character A is activated by user and there are 2 other members (B and C) detected, those 3 members (A, B, C) will start this conversation initiated by A, because A has become the 'master' character in this conversation. So master character A will say "Chit Chat Chit Chat! Do you want to sing a song?" (then all characters perform the scanning process to confirm if there's any change of status). If no changes detected, all other detected members will respond "Yes"/"Yeah dude!"/"Oh yeah!" all together; in this case, B will respond "Yes" and C will respond "Yeah dude!" but there isn't any character to say "Oh yeah!" because there are only 2 other characters detected. (then all characters perform the scanning process to confirm if there's any change of status). If no changes detected.

If there isn't any new character(s) detected and they will all continue the next phrase with 3 members (A, B, C) initiated by the master character A. Master character A will say "Sing along with me, one, two . . . ", (then all characters perform the scanning process to confirm if there's any change of status). If no changes detected, suddenly A is interrupted by one of the other detected members, randomly B is the one who says "Wait! I'm not ready yet! . . . OK, I'm ready." (then all characters perform the scanning process to confirm if there's any change of status). If no changes detected, master A continues to say "ONE, TWO, THREE", (then all characters perform the scanning process to confirm if there's any change of status). If F has been removed or power OFF, only the remaining characters (A,B,C,D,E) will continue to sing the Chitty Chatz theme song all together. (then all characters perform the scanning process to confirm if there's any change of status). If no changes detected, one of the detected members will say "That was fun!", (then all characters perform the scanning process to confirm if there's any change of status). If no changes detected, all detected characters laugh together and randomly one of them will say "YEAH!!!" at the end.

After that, the master character (A) will lead to the next interactive conversation (see FIG. 6.4) if trigger 1 conversation switch is activated by the user again. If trigger 1 is not being activated by user, all characters will be in stand-by mode. In case of trigger 1 on any of the detected members is pressed at any time during the conversation, interactive conversation will be interrupted/stopped immediately.

FIG. 6.4 is a flow chart illustrating the interactive conversation 4. The character being activated by user will become the master character of this conversation. The character will emit and detect coded signals from others, the other stand-by characters will also emit and detect coded signals from others. Once they confirm there is/are other member(s) within the detectable range, they will also detect how many members are within the detectable range and confirm their identity based on the codes they received. The process of emit and detect signals, confirming number of detected members and identifying the detected member is defined as the scanning process (FIG. 6A), this process will be performed frequently, basically after each phrase in the conversation.

For example, trigger 1 on character A is activated by user and there are 2 other members (B and C) detected, those 3 members (A,B,C) will start this conversation initiated by A, because A has become the 'master' character in this conversation. So master character A will say "Hi! Do you speak Chitty Chatz language?" (then all characters perform the scanning process to confirm if there's any change of status). If no changes detected, one of the other detected members (either B or C) will respond "I don't know, can you teach me?", and master A responds right away "I can teach you more anyway" (then all characters perform the scanning process to confirm if there's any change of status). If there are 3 more new characters detected (D,E,F) then they will all continue the next phrase with 6 members (A,B,C,D,E,F) so all the detected members will say "Great"/"Cool"/"OK" respectively at the same time, B will say "Great", C will say "Cool", D will say "OK", E will say "Great", F will say "Cool". At the end of this phrase, all characters will perform the scanning process to confirm the latest chatting environment/status.

Master character A says "chit chit chat chit chit chat chit chit chit chit chat", (then all characters perform the scanning process to confirm if there's any change of status). If no changes detected, all detected members will repeat what master A just said "chit chit chat chit chit chat chit chit chit chit chatz" (then all characters perform the scanning process to confirm if there's any change of status). If no changes detected, master A continues to say "CHIT CHIT ZEE ZEE ZAT", (then all characters perform the scanning process to confirm if there's any change of status), all detected members will repeat what master A just said "CHIT CHIT ZEE ZEE ZAT" (then all characters perform the scanning process to confirm if there's any change of status). If no changes detected, master A will say "MIT MIT MAT ZEE ZEE ZAT", (then all characters perform the scanning process to confirm if there's any change of status). If no changes detected, all other detected members will repeat what master A just said "MIT MIT MAT ZEE ZEE ZAT" (then all characters perform the scanning process to confirm if there's any change of status). If no changes detected, one of the detected members will say "That was fun!" (then all characters perform the scanning process to confirm if there's any change of status). If no changes detected, one other detected members will say "Let's get crazy!", one of the other detected members will then say "Are you kidding me?", (then all characters perform the scanning process to confirm if there's any change of status). If no changes detected, all detected characters laugh together.

After that, the master character (A) will lead to the next interactive conversation (see FIG. 6.5) if trigger 1 conversation switch is activated by the user again. If trigger 1 is not being activated by user, all characters will be in stand-by mode. In case of trigger 1 on any of the detected members is pressed at any time during the conversation, interactive conversation will be interrupted/stopped immediately.

FIG. 6.5 is a flow chart illustrating interactive conversation 5. The character being activated by user will become the master character of this conversation. The character will emit and detect coded signals from others, the other stand-by characters will also emit and detect coded signals from others. Once they confirm there is/are other member(s) within the detectable range, they will also detect how many members are within the detectable range and confirm their identity based on the codes they received. The process of emit and detect signals, confirming number of detected members and identifying the detected member is defined as the scanning process (FIG. 6A), this process will be performed frequently, basically after each phrase in the conversation.

For example, trigger 1 on character A is activated by user and there are 2 other members (B and C) detected, those 3 members (A,B,C) will start this conversation initiated by A, because A has become the 'master' character in this conversation. so master character A will start 'mumbling' (then all characters perform the scanning process to confirm if there's any change of status). If no changes detected, all other detected members (B&C) will what master A was 'mumbling', then one of the other detected members will say "What did you say?", B is the one being chosen this time, then master A will responds right away "I say what you say!" (then all characters perform the scanning process to confirm if there's any change of status). If there are 1 more new character detected (D) then they will all continue the next phrase with 4 members (A,B,C,D), one of the detected members will say "Are you kidding me?", B is the one being chosen to say that this time, then Master A will repeat "Are you kidding me?" right away, (then all characters perform the scanning process to confirm if there's any change of status). If no changes detected, one of the detected members will say "PEEK-A-BOO" Master A will repeat "PEEK-A-BOO" right away; (then all characters perform the scanning process to confirm if there's any change of status). If no changes detected, one of the detected members will say "CHIAO" Master A will repeat "CHIAO" right away, then all detected members will laugh together.

After that, the master character (A) will lead to the next interactive conversation (see FIG. 6.6) if trigger 1 conversation switch is activated by the user again. If trigger 1 is not being activated by user, all characters will be in stand-by mode. In case of trigger 1 on any of the detected members is pressed at any time during the conversation, interactive conversation will be interrupted/stopped immediately.

FIG. 6.6 is a flow chart illustrating interactive conversation 6. The character being activated by user will become the master character of this conversation. The character will emit and detect coded signals from others. The other stand-by characters will also emit and detect coded signals from others. Once they confirm there is/are other member(s) within the detectable range, they will also detect how many members are within the detectable range and confirm their identity based on the codes they received. The process of emit and detect signals, confirming number of detected members and identifying the detected member is defined as the scanning process (FIG. 6A), this process will be performed frequently, basically after each phrase in the conversation.

For example, trigger 1 on character A is activated by user and there are 2 other members (B and C) detected, those 3 members (A,B,C) will start this conversation initiated by A, because A has become the 'master' character in this conversation. so master character A will say "Chit Chat Chit Chat, let's play riddles!" (then all characters perform the scanning process to confirm if there's any change of status). If no changes detected, all other detected members (B&C) will respond "OK"/"OK broh"/"Cool"/"Oh yeah"/"YEAH" respectively at the same time. In this case, only B and C will respond, so B will say "OK", C will say "OK broh".

Master A will then ask "What did a spider do on a computer?" then all characters perform the scanning process to confirm if there's any change of status). If no changes detected, one of the detected members (B/C) will respond "Made a website!" all other detected members (B,C) will say "YEAH!" or "Oh YEAH!" respectively at the same time. Master A will then ask "What do you call a dog on a beach?" (then all characters perform the scanning process to confirm if there's any change of status). If no changes detected, one of the detected members (B/C) will say "A HOTDOG!", B is the one being chosen to say that this time, all other detected members will say "YEAH!" or "Oh YEAH!" respectively at the same time, C is the one being chosen this time. Master will then ask "What has 4 wheels and flies?" (then all characters perform the scanning process to confirm if there's any change of status). If no changes detected, one of the detected members (B/C) will say "A garbage truck!", C is the one this time, all other detected members (B) will say "YEAH!" or "Oh YEAH!" respectively at the same time and then all detected members will laugh together.

After that, the master character (A) will lead to the next interactive conversation (see FIG. 6.7) if trigger 1 conversation switch is activated by the user again. If trigger 1 is not being activated by user, all characters will be in stand-by mode. In case of trigger 1 on any of the detected members is pressed at any time during the conversation, interactive conversation will be interrupted/stopped immediately.

FIG. 6.7 is a flow chart illustrating interactive conversation 7. The character being activated by user will become the master character of this conversation. The character will emit and detect coded signals from others. The other stand-by characters will also emit and detect coded signals from others. Once they confirm there is/are other member(s) within the detectable range, they will also detect how many members are within the detectable range and confirm their identity based on the codes they received. The process of emit and detect signals, confirming number of detected members and identifying the detected member is defined as the scanning process (FIG. 6A), this process will be performed frequently, basically after each phrase in the conversation.

For example, trigger 1 on character A is activated by user and there are 5 other members (B, C, D, E, F) detected, those 6 members (A, B, C, D, E, F) will start this conversation initiated by A, master character A will ask "What kind of food do you like?" (then all characters perform the scanning process to confirm if there's any change of status). If no changes detected, all other detected members (B, C, D, E, F) will respond one by one.

- A says "I like corn" (then emit and detect signals to the others) C&D detected the signal from A that carries the code of "corn" so they will say "I like that too" because they are programmed to be loving the food "corn".
- B says "I like all kinds of nuts" (then emit and detect signals to the others), no other members will respond because none of them like all kinds of nuts.
- C says "I like peanut" (then emit and detect signals to the others), A&B detected the signal from A that carries the code of "peanut" so they will say "I like that too" because they are programmed to be loving the food "peanut"
- D says "I like vegetables" (then emit and detect signals to the others), no other members will respond because none of them like vegetables.
- E says "I like bananas" (then emit and detect signals to the others), no other members will respond because none of them like bananas
- F says "I like everything!" (then emit and detect signals to the others), no other members will respond because none of them like everything.

(then all characters perform the scanning process to confirm if there's any change of status). If no changes detected, one of the detected members (randomly picked) will say "I'm hungry, let's get something to eat now." (then all characters perform the scanning process to confirm if there's any change of status). If no changes detected, all other detected members will say "Great"/"Cool"/"OK"/"Let's do it"/"Oh Yeah" respectively at the same time. In this example, all 6 characters are detected, so B will say "Great", C will say "Cool", D will say "OK", E will say "Let's do it!" and F will say "Oh yeah!".

After that, the master character (A) will lead to the next interactive conversation (see FIG. 6.1) if trigger 1 conversation switch is activated by the user again. If trigger 1 is not being activated by user, all characters will be in stand-by mode. In case of trigger 1 on any of the detected members is pressed at any time during the conversation, interactive conversation will be interrupted/stopped immediately.

FIG. 7 is a flow chart illustrating the reminder mode of a toy unit. If any of the characters being idled for over 10 seconds, which means none of the triggers/sensors has been activated by the user or it has not been able to detect any signals from other members after 10 seconds, the character will then go into Reminder Mode STAGE 1. In reminder mode stage 1, the character will say something like "Hello! Chitty Chatz" "Are you there?" "Don't go away, let's play!" to get user's attention. If the character is still not being activated by the user and has been idled for another 10 seconds, the character will go into reminder mode STAGE 2. If any of the triggers/sensors has been activated by the user, the character will switch to a different mode accordingly; For example, it will go into talk back mode if the talk back activation switch is activated by the user.

When the character goes into reminder mode STAGE 2, it will say something like "Are you there?" If the character is still not being activated by the user and has been idled for another 5 seconds, the character will say "GOODBYE!" and go into sleeping mode to reserve battery. If any of the triggers/sensors has been activated by user before it goes into sleeping mode, the character will switch to a different mode accordingly; For example, it will go into conversation mode if trigger 1 (the conversation activation switch) is activated by the user.

After going into sleeping mode, there are 2 ways to wake up the character: 1) User can press either the conversation activation switch or the talk back activation switch once to wake up the character from sleeping mode to stand-by mode; 2) User can turn the main power switch from OFF to ON position.

Table 7 shows the machine code for different voices used by the system.

| No. | Code | Description |
|---|---|---|
| 1 | CC-001 | HELLO A |
| 2 | CC-002 | HELLO B |
| 3 | CC-003 | CHITTY CHATZ |
| 4 | CC-004 | HELLO C |
| 5 | CC-005 | HI |
| 6 | CC-006 | TOOKIE |
| 7 | CC-007 | ZEZEE |
| 8 | CC-008 | HEWY |
| 9 | CC-009 | O-BOY |
| 10 | CC-010 | BOINKY |
| 11 | CC-011 | KOKEY |
| 12 | CC-012 | MY NAME IS |
| 13 | CC-013 | HOW R U DOING |
| 14 | CC-014 | WHATZZUP A |
| 15 | CC-015 | WHATZZUP B |

In above embodiments, the prerecorded phrases are grouped into conversations, and the controller IC is configured to control the speaker to output the prerecorded phrases in a predetermined sequence with the other toy units to carry on a predetermined number of conversations in a predetermined cycle.

The controller IC is configured to set a bump heads mode for the toy unit, and to control the speaker to output a series of phrases in turn with another toy unit, the other toy unit being configured to be also set in the bump heads mode. The controller IC is configured to set a talk back mode for the toy unit, to record a voice acquired by the microphone, to modify the pitch of the voice, and control the speaker to output the modified voice. The controller IC is configured to set an interactive conversation mode for the toy unit, to detect other toy units that are also set in the same mode, and to control the speaker to output a series of voices in turn with those other toy units.

The controller IC is configured to set a single mode for the toy unit, and to control the speaker to output a series of phrases grouped into a plurality of conversations in a cycle. The controller IC is configured to set a reminder mode for the toy unit if the toy unit has been idled for a first predetermined time period, and to control the speaker to output a series of phrases reminding a user. The controller IC is configured to set a sleeping mode for the toy unit if the toy unit has been idled for a second predetermined time period, and to power off the toy unit.

According to another embodiment of the present patent application, an interactive talking toy includes a plurality of toy units. Each toy unit includes: a transmitter configured to transmit a signal to the other toy units; a receiver configured to receive a signal from the other toy units; a speaker configured to output a voice; and a controller IC being connected with the transmitter, the receiver, and the speaker, and configured to set a plurality of modes for the toy unit based on the communication between the toy unit and the other toy units, and selectively control the speaker to output prerecorded phrases in a predetermined sequence along with the other toy units according to the mode being set for the toy unit and for the other toy units respectively. The controller IC is configured to check the mode being set for the other toy units at the end of each phrase, and to control the speaker to proceed with outputting the prerecorded phrases in the predetermined sequence along with toy units that are set in a predetermined mode.

The controller IC may include a ROM and a RAM for storing instructions and data, and a driver circuit for driving the speaker with a PWM signal. The toy unit may further include a microphone being connected with the controller IC and configured to acquire a voice input, and an audio codec processor being connected to the microphone and the controller IC, the audio codec processor including an ADC and a DAC, and being configured to process voice input acquired by the microphone and send the processed audio data to the controller IC. The audio codec processor may further include an auto gain control circuit and an equalizer amplifier.

The transmitter may include a light-emitting diode for emitting an infrared optical signal to the other toy units. The receiver includes a photodiode for receiving an infrared optical signal from the other toy units. The controller IC may include a motor driver configured for driving a motor, and a watch dog timer for generating a timing signal.

The prerecorded phrases may be grouped into conversations, and the controller IC may be configured to control the speaker to output the prerecorded phrases in a predetermined sequence along with the other toy units to carry on a predetermined number of conversations in a predetermined cycle.

The controller IC may be configured to set a bump heads mode for the toy unit, and to control the speaker to output a series of phrases in turn with another toy unit, the other toy unit being configured to be also set in the bump heads mode. The controller IC may be configured to set a talk back mode for the toy unit, to record a voice acquired by the microphone, to modify the pitch of the voice, and to control the speaker to output the modified voice.

The controller IC may be configured to set an interactive conversation mode for the toy unit, to detect other toy units that are also set in the same mode, and to control the speaker to output a series of phrases in turn along with those detected toy units. The controller IC may be configured to check the mode being set for the other toy units at the end of each phrase, and to control the speaker to proceed with outputting a predetermined set of conversations with toy units that are also set in the interactive conversation mode in a predetermined cycle so that the conversations are continuously carried on even if a toy unit leaves or joins an on-going conversation.

The controller IC may be configured to set a single mode for the toy unit, and to control the speaker to output a series of phrases grouped into a plurality of conversations in a cycle. The controller IC may be configured to set a reminder mode for the toy unit if the toy unit has been idled for a first predetermined time period, and to control the speaker to output a series of phrases reminding a user. The controller IC may be configured to set a sleeping mode for the toy unit if the toy unit has been idled for a second predetermined time period, and to power off the toy unit.

According to another embodiment of the present patent application, a method for interactive role playing implemented by an interactive talking toy is provided. The interactive talking toy includes a plurality of toy units. The method includes: transmitting a signal with a transmitter of a toy unit to the other toy units; receiving a signal from the other toy units with a receiver of the toy unit; outputting a voice with a speaker of the toy unit; setting a plurality of modes for the toy unit based on the communication between the toy unit and the other toy units, and selectively controlling the speaker to output prerecorded phrases in a predetermined sequence along with the other toy units according to the mode being set for the toy unit and for the other toy units respectively with a controller IC of the toy unit; and checking the mode being set for the other toy units at the end of each phrase, and controlling the speaker to proceed with outputting the prerecorded phrases in the predetermined sequence along with toy units that are set in a predetermined mode.

In the method, the prerecorded phrases may be grouped into conversations while the speaker is controlled by the controller IC to output the prerecorded phrases in a predetermined sequence along with the other toy units to carry on a predetermined number of conversations in a predetermined cycle.

The method may further include setting an interactive conversation mode for the toy unit, detecting other toy units that are also set in the same mode, and controlling the speaker to output a series of phrases in turn along with those detected toy units.

According to yet another embodiment, an interactive talking toy includes a plurality of toy units. Each toy unit includes: a transmitter configured to transmit a signal to the other toy units; a receiver configured to receive a signal from the other toy units; a microphone configured to acquire a voice input; a speaker configured to output a voice; and a controller IC being connected with the transmitter, the receiver, the microphone and the speaker, and configured to set a plurality of modes for the toy unit based on the communication between the toy unit and the other toy units, and selectively control the speaker to output prerecorded phrases in a predetermined sequence along with the other toy units according to the mode being set for the toy unit and for the other toy units respectively. The controller IC is configured to check the mode being set for the other toy units at the end of each phrase, and to control the speaker to proceed with outputting the prerecorded phrases in the predetermined sequence along with toy units that are set in a predetermined mode. The controller IC is configured to set a talk back mode for the toy unit, to record a voice acquired by the microphone, to modify the pitch of the voice, and to control the speaker to output the modified voice. The controller IC is further configured to set an interactive conversation mode for the toy unit, to detect other toy units that are also set in the same mode, and to control the speaker to output a series of phrases in turn along with those detected toy units.

While the present patent application has been shown and described with particular references to a number of embodiments thereof, it should be noted that various other changes or modifications may be made without departing from the scope of the present invention.

What is claimed is:

1. An interactive talking toy comprising a plurality of toy units, each toy unit comprising:

a transmitter configured to transmit a signal to the other toy units;

a receiver configured to receive a signal from the other toy units;

a speaker configured to output a voice; and a controller IC being connected with the transmitter, the receiver, and the speaker, and configured to set a plurality of modes for the toy unit based on the communication between the toy unit and the other toy units, and selectively control the speaker to output prerecorded phrases in a predetermined sequence along with the other toy units according to the mode being set for the toy unit and for the other toy units respectively; wherein:

the controller IC is configured to check the mode being set for the other toy units at the end of each phrase, and to control the speaker to proceed with outputting the prerecorded phrases in the predetermined sequence along with toy units that are set in a predetermined mode.

2. The interactive talking toy of claim 1, wherein the controller IC comprises a ROM and a RAM for storing instructions and data, and a driver circuit for driving the speaker with a PWM signal.

3. The interactive talking toy of claim 1, wherein the toy unit further comprises a microphone being connected with the controller IC and configured to acquire a voice input, and an audio codec processor being connected to the microphone and the controller IC, the audio codec processor comprising an ADC and a DAC, and being configured to process voice input acquired by the microphone and send the processed audio data to the controller IC.

4. The interactive talking toy of claim 3, wherein the audio codec processor further comprises an auto gain control circuit and an equalizer amplifier.

5. The interactive talking toy of claim 3, wherein the controller IC is configured to set a talk back mode for the toy unit, to record a voice acquired by the microphone, to modify the pitch of the voice, and to control the speaker to output the modified voice.

6. The interactive talking toy of claim 1, wherein the transmitter comprises a light-emitting diode for emitting an infrared optical signal to the other toy units, and the receiver comprises a photodiode for receiving an infrared optical signal from the other toy units.

7. The interactive talking toy of claim 1, wherein the controller IC comprises a motor driver configured for driving a motor, and a watch dog timer for generating a timing signal.

8. The interactive talking toy of claim 1, wherein the prerecorded phrases are grouped into conversations, and the controller IC is configured to control the speaker to output the prerecorded phrases in a predetermined sequence along with the other toy units to carry on a predetermined number of conversations in a predetermined cycle.

9. The interactive talking toy of claim 1, wherein the controller IC is configured to set a bump heads mode for the toy unit, and to control the speaker to output a series of phrases in turn with another toy unit, the other toy unit being configured to be also set in the bump heads mode.

10. The interactive talking toy of claim 1, wherein the controller IC is configured to set an interactive conversation mode for the toy unit, to detect other toy units that are also set in the same mode, and to control the speaker to output a series of phrases in turn along with those detected toy units.

11. The interactive talking toy of claim 10, wherein the controller IC is configured to check the mode being set for the other toy units at the end of each phrase, and to control the speaker to proceed with outputting a predetermined set of conversations with toy units that are also set in the interactive conversation mode in a predetermined cycle so that the conversations are continuously carried on even if a toy unit leaves or joins an on-going conversation.

12. The interactive talking toy of claim 1, wherein the controller IC is configured to set a single mode for the toy unit, and to control the speaker to output a series of phrases grouped into a plurality of conversations in a cycle.

13. The interactive talking toy of claim 1, wherein the controller IC is configured to set a reminder mode for the toy unit if the toy unit has been idled for a first predetermined time period, and to control the speaker to output a series of phrases reminding a user.

14. The interactive talking toy of claim 13, wherein the controller IC is configured to set a sleeping mode for the toy unit if the toy unit has been idled for a second predetermined time period, and to power off the toy unit.

15. A method for interactive role playing implemented by an interactive talking toy, the interactive talking toy comprising a plurality of toy units, the method comprising:

transmitting a signal with a transmitter of a toy unit to the other toy units;

receiving a signal from the other toy units with a receiver of the toy unit;

outputting a voice with a speaker of the toy unit;

setting a plurality of modes for the toy unit based on the communication between the toy unit and the other toy units, and selectively controlling the speaker to output prerecorded phrases in a predetermined sequence along with the other toy units according to the mode being set for the toy unit and for the other toy units respectively with a controller IC of the toy unit; and checking the mode being set for the other toy units at the end of each phrase, and controlling the speaker to proceed with outputting the prerecorded phrases in the predetermined sequence along with toy units that are set in a predetermined mode.

16. The method of claim 15, wherein the prerecorded phrases are grouped into conversations while the speaker is controlled by the controller IC to output the prerecorded phrases in a predetermined sequence along with the other toy units to carry on a predetermined number of conversations in a predetermined cycle.

17. The method of claim 15 further comprising setting an interactive conversation mode for the toy unit, detecting other toy units that are also set in the same mode, and controlling the speaker to output a series of phrases in turn along with those detected toy units.

18. An interactive talking toy comprising a plurality of toy units, each toy unit comprising:

a transmitter configured to transmit a signal to the other toy units;

a receiver configured to receive a signal from the other toy units;

a microphone configured to acquire a voice input;

a speaker configured to output a voice; and a controller IC being connected with the transmitter, the receiver, the microphone and the speaker, and configured to set a plurality of modes for the toy unit based on the communication between the toy unit and the other toy units, and selectively control the speaker to output prerecorded phrases in a predetermined sequence along with the other toy units according to the mode being set for the toy unit and for the other toy units respectively; wherein:

the controller IC is configured to check the mode being set for the other toy units at the end of each phrase, and to control the speaker to proceed with outputting the prerecorded phrases in the predetermined sequence along with toy units that are set in a predetermined mode;

the controller IC is configured to set a talk back mode for the toy unit, to record a voice acquired by the microphone, to modify the pitch of the voice, and to control the speaker to output the modified voice; and the controller IC is further configured to set an interactive conversation mode for the toy unit, to detect other toy units that are also set in the same mode, and to control the speaker to output a series of phrases in turn along with those detected toy units.

19. The interactive talking toy of claim 18, wherein the transmitter comprises a light-emitting diode for emitting an infrared optical signal to the other toy units, and the receiver comprises a photodiode for receiving an infrared optical signal from the other toy units.

20. The interactive talking toy of claim 18, wherein the prerecorded phrases are grouped into conversations, and the controller IC is configured to control the speaker to output the prerecorded phrases in a predetermined sequence along with the other toy units to carry on a predetermined number of conversations in a predetermined cycle.

* * * * *